US008822122B2

(12) United States Patent
Soda

(10) Patent No.: US 8,822,122 B2
(45) Date of Patent: Sep. 2, 2014

(54) IMAGE FORMING APPARATUS AND IMAGE FORMING METHOD

(71) Applicant: KYOCERA Document Solutions Inc., Osaka (JP)

(72) Inventor: Tomohisa Soda, Osaka (JP)

(73) Assignee: Kyocera Document Solutions Inc. (JP)

( * ) Notice: Subject to any disclaimer, the term of this patent is extended or adjusted under 35 U.S.C. 154(b) by 74 days.

(21) Appl. No.: 13/742,388

(22) Filed: Jan. 16, 2013

(65) Prior Publication Data

US 2013/0189615 A1 Jul. 25, 2013

(30) Foreign Application Priority Data

Jan. 23, 2012 (JP) ..... 2012-011252

(51) Int. Cl.

| | |
|---|---|
| ***G03G 9/125*** | (2006.01) |
| ***G03G 13/10*** | (2006.01) |
| ***G03G 15/01*** | (2006.01) |
| ***G03G 13/01*** | (2006.01) |
| ***G03G 15/20*** | (2006.01) |
| ***G03G 15/10*** | (2006.01) |

(52) U.S. Cl.

CPC ..... *G03G 13/01* (2013.01); *G03G 15/0131* (2013.01); *G03G 2215/2074* (2013.01); *G03G 15/0189* (2013.01); *G03G 15/2092* (2013.01); *G03G 15/10* (2013.01)

USPC ..... 430/117.4; 430/117.5; 399/121; 399/319; 399/339

(58) Field of Classification Search

CPC ..... G03G 13/16; G03G 9/12; G03G 7/004; G03G 13/10; G03G 9/132; G03G 2221/1642; G03G 21/16; G03G 15/1605; G03G 15/2092; G03G 15/165; G03G 15/26; G03G 21/0005; B06B 3/00

USPC ..... 430/117.4, 117.5; 399/121, 319, 339

See application file for complete search history.

(56) References Cited

U.S. PATENT DOCUMENTS

2012/0301192 A1* 11/2012 Ueda ..... 399/313

FOREIGN PATENT DOCUMENTS

| | | |
|---|---|---|
| JP | 2008-90116 | 4/2008 |
| JP | 2009-98474 | 5/2009 |

* cited by examiner

*Primary Examiner* — Hoa V Le

(74) *Attorney, Agent, or Firm* — Gerald E. Hespos; Michael J. Porco; Matthew T. Hespos

(57) ABSTRACT

The present application discloses an image forming apparatus which uses at least two types of liquid developer to form a plurality of images that are superimposed on a sheet to form an image. The image forming apparatus includes a transfer mechanism configured to transfer the image to the sheet, an image forming mechanism configured to make the transfer mechanism carry the image, and a rubbing mechanism configured to rub the image on the sheet. The at least two types of liquid developer have different fixing properties from each other. The transfer mechanism includes a carrying surface configured to carry the image from the image forming mechanism. One of the plurality of images between the carrying surface and another of the plurality of images has higher fixing properties than the liquid developer used for forming the other image among the plurality of images.

8 Claims, 18 Drawing Sheets

IMAGE FORMING APPARATUS AND IMAGE FORMING METHOD

The present application claims priority to Japanese Patent Application No. 2012-11252 filed with Japanese Patent Office on Jan. 23, 2012, the contents of which are hereby incorporated by reference.

BACKGROUND

The disclosure herein relates to an image forming apparatus and an image forming method for forming images on sheets.

An image forming apparatus which uses liquid developer is known as a device for forming an image on a sheet. This type of image forming apparatuses typically has a fixing device configured to fix images onto sheets. The fixing device generates high heat in order to melt toner contained in the liquid developer, which is transferred onto the sheet.

It is not necessary for a fixing device to generate heat if the fixing device uses liquid developer which has characteristics such that its components (carrier solution) permeate into a sheet and high-molecular compounds with dispersed pigment therein deposit on the surface of the sheet. However, the present inventors discovered disadvantageous properties which are likely to cause peel-off of an image formed on the sheet by means of such liquid developer.

The present inventors devised non-heating fixing techniques to prevent peel-off of an image from a sheet. According to studies of the present inventors, an image is less likely to come off from a sheet if the image formed with the aforementioned liquid developer is rubbed on the sheet. According to various studies of the present inventors, the longer a period during which an image is rubbed, the higher a fixation ratio of an image on a sheet. Further, if the image is rubbed in various directions, the fixation ratio of the image on the sheet becomes higher.

An image represented by several hues has to be formed by means of several types of liquid developer. The aforementioned fixing properties of the liquid developer depend on components of the liquid developer. Differences of pigment for determining hues of an image result in differences of the fixation ratio between color components in the image. Thus, even if the aforementioned rubbing technologies are applied, a sufficient fixation ratio may be not achieved.

The aforementioned problem is not limited only to the case where an image is formed with several hues. Even in the case of forming a single-color image, a problem of an insufficient fixation ratio is brought about if several types of liquid developer are used.

The present disclosure aims to provide an image forming apparatus and an image forming method, which achieve a high image fixation ratio under usage of several types of liquid developer.

SUMMARY

An image forming apparatus according to one aspect of the present disclosure includes a transfer mechanism configured to transfer the image to the sheet, an image forming mechanism configured to make the transfer mechanism carry the image, and a rubbing mechanism configured to rub the image on the sheet. The at least two types of liquid developer have different fixing properties from each other. The transfer mechanism includes a carrying surface configured to carry the image from the image forming mechanism. One of the plurality of images between the carrying surface and another of the plurality of images has higher fixing properties than the liquid developer used for forming the other image among the plurality of images.

An image forming method according to another aspect of the present disclosure includes a step of forming the image by transferring the plurality of images to a carrying surface, a step of transferring the image from the carrying surface to the sheet; and a step of rubbing the image on the sheet. One of the plurality of images between the carrying surface and another of the plurality of images has higher fixing properties than the liquid developer used for forming the other image among the plurality of images.

DETAILED DESCRIPTION

An exemplary image forming apparatus and an exemplary image forming method are described with reference to the accompanying drawings. Directional terms used hereinafter such as "upper/above", "lower/below", "left" and "right" are merely to clarify description. Therefore, the drawings and the following details do not limit principles of the image forming apparatus and method.

<Fixation Method>

Principles of fixing an image formed by means of single liquid developer are described before explanation about fixation of an image formed by means of several types of liquid developer. The description about the following fixing principles is also applied to the fixation of an image formed by means of several types of liquid developer.

Figure 1A:
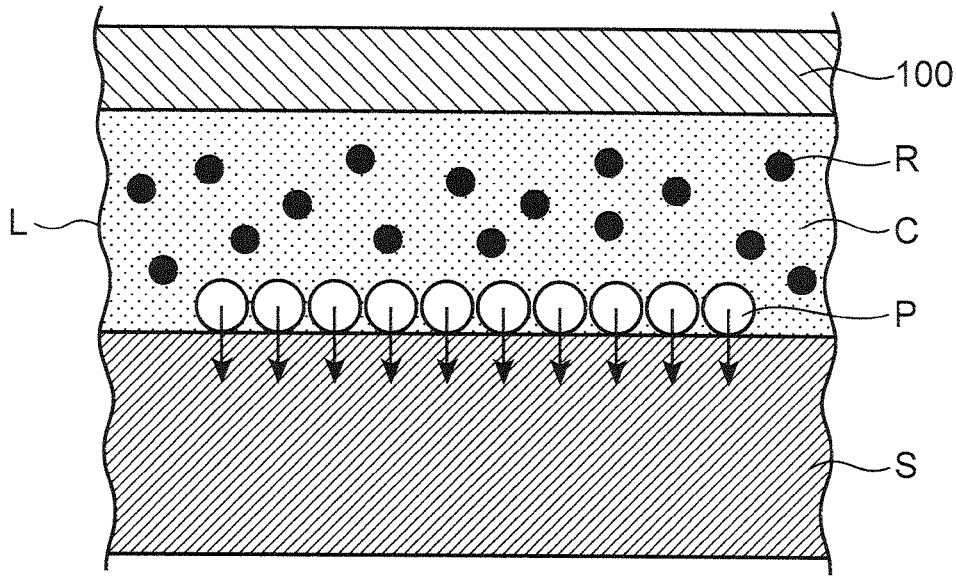
FIGS. 1A to 1C are schematic views respectively showing a transfer process of an image using liquid developer.
Figure 1B:
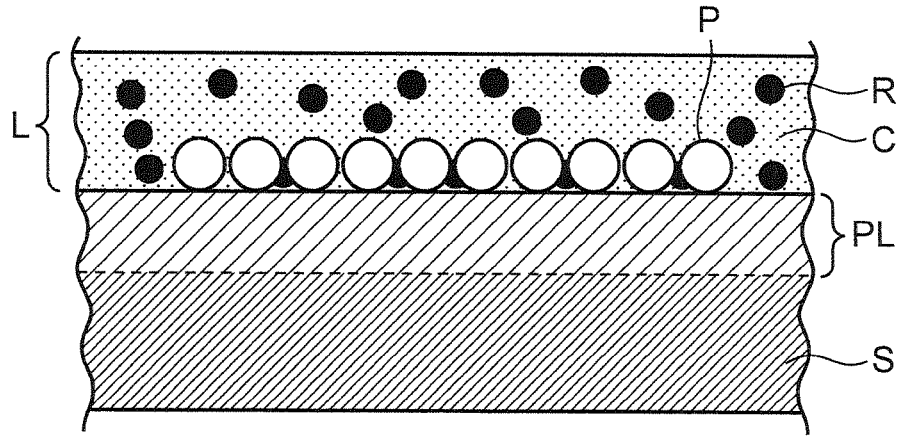
Figure 1C:
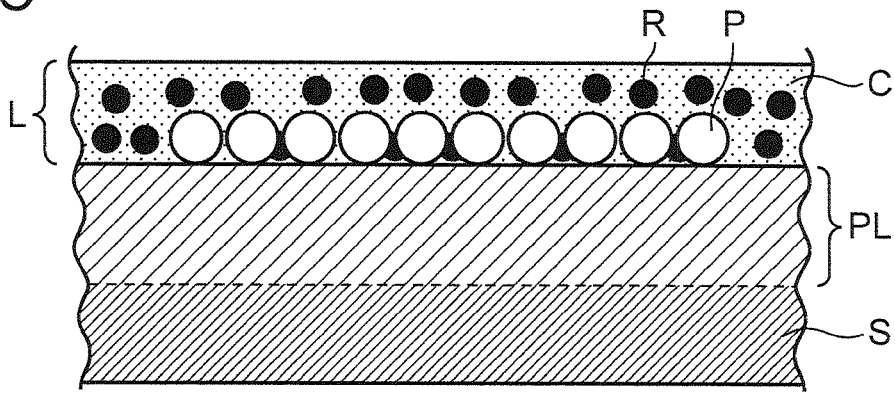

FIGS. 1A to 1C schematically show a transfer process for transferring an image obtained by means of liquid developer, respectively. The transfer process is sequentially performed in the order of FIGS. 1A to 1C. The image transfer to a sheet and the image obtained after the transfer are described with reference to FIGS. 1A to 1C.

FIG. 1A is a schematic cross-sectional view showing a liquid layer L of liquid developer, which forms an image transferred from an image carrier 100 to a sheet S. For example, the image carrier 100 may be a transfer belt equipped in an image forming apparatus (e.g., a printer, copier, facsimile device or complex machine with their functions), which uses the liquid developer to form images. The image carrier 100 conveys the liquid layer L of the liquid developer to a transfer position at which the liquid layer L is transferred to the sheet S to form the image on the sheet.

The sheet S comes into contact with the liquid layer L on the image carrier 100 at the transfer position. The liquid layer L of the liquid developer, which is used for forming the image, includes carrier liquid C, colored particles P for coloring an image, and polymer compounds R dissolved or swollen in the carrier liquid C. The colored particles P, which are dispersed in the carrier liquid C, are electrostatically attracted to the sheet S. Thus, the colored particles P adhere to the sheet S and form an image. For example, the attraction of the colored particles P to the sheet S is accomplished by an electric field across the sheet S. Principles about the attraction of the colored particles P to the sheet S are described in details in the context of the following image forming apparatus.

FIG. 1B schematically shows the carrier liquid C permeating into the sheet S. The carrier liquid C with low kinetic viscosity permeates into the sheet S to form a permeation layer PL in a surface layer of the sheet S. The polymer compounds R in the liquid layer L of the liquid developer become more concentrated as the carrier liquid C permeates into the sheet S.

As shown in FIG. 1C, when the carrier liquid C further permeates into the sheet S, the polymer compounds R of the liquid layer L deposit on the surface of the sheet S. As described above, the colored particles P electrostatically adhere to the sheet S before the deposition of the polymer compounds R. Therefore, the polymer compounds R depositing on the surface of the sheet S form a coating layer, which is laminated on the layer of the colored particles P that forms the image on the sheet S.

Figure 2A:
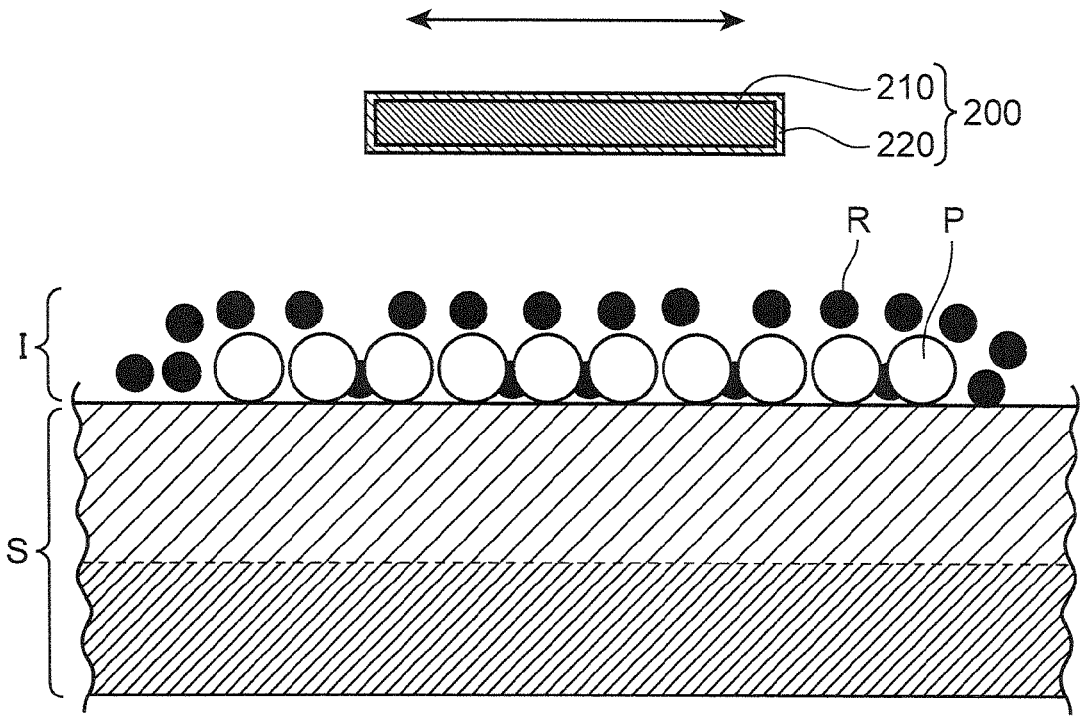
FIGS. 2A and 2B are schematic views showing a fixing process after the transfer process.
Figure 2B:
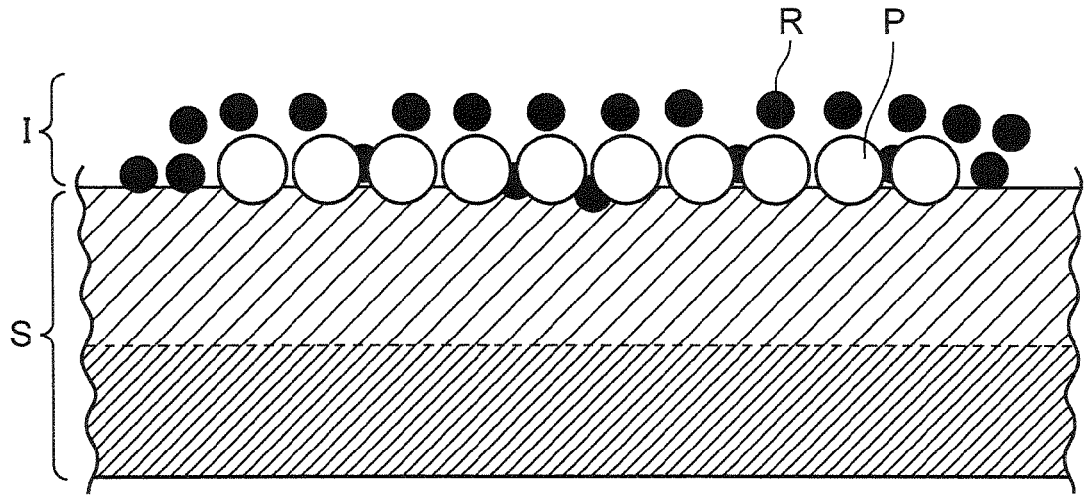

FIGS. 2A and 2B schematically show a fixation process after the transfer process. FIG. 2A schematically shows the fixation process. FIG. 2B is a schematic cross-sectional view of the sheet S after the fixation process. Principles about the fixation process is described with reference to FIGS. 1A to 2B.

After the transfer process, the carrier liquid C substantially permeates into the sheet S, so that an image layer I with the polymer compounds R and the colored particles P is formed on the sheet S. In the transfer process, the image layer I is not subjected to any physical force except for a pressure and electric field generated during the transfer of the liquid layer L (image) from the image carrier 100 to the sheet S. Therefore, before the fixation process, a physical bond between the image layer I and the sheet S is weak, so that the image layer I may be noticeably peeled off as a result of the following peel test using a tape.

FIG. 2A shows a rubbing plate 200, which is used for rubbing an image. For example, the rubbing plate 200 has a substantially rectangular board 210, and a nonwoven fabric 220 covering the surface of the board 210. In the present embodiment, a polypropylene nonwoven fabric is used as the nonwoven fabric 220. Alternatively, a polytetrafluoroethylene (PTFE) nonwoven fabric having a dynamic friction coefficient of 0.10 (referred to as "PTFE felt A," hereinafter), a polytetrafluoroethylene (PTFE) nonwoven fabric having a dynamic friction coefficient of 0.13 (referred to as "PTFE felt B," hereinafter), a polyester felt, a polyethylene terephthalate felt (referred to as "PET felt," hereinafter), a polyamide felt or a wool felt, may be used as the nonwoven fabric 220.

The rubbing plate 200 placed on the image layer I on the sheet S moves over the image layer I along the upper surface of the sheet S. Consequently, a part of components of the image layer I (the colored particles P and/or the polymer compounds R) engages into the surface layer of the sheet S (anchor effect), as shown in FIG. 2B. This reinforces a physical bond between the image layer I and the sheet S.

As described above, the upper surface of the image layer I is covered with the polymer compounds R. The cover layer of the polymer compounds R which covers the colored particles P for coloring the image is strengthened by the rubbing operation of the rubbing plate 200. Therefore, the image layer I is appropriately protected. Thus, the image is less likely to be damaged by the rubbing operation of the rubbing plate 200.

(Experiment 1)

Figure 3:
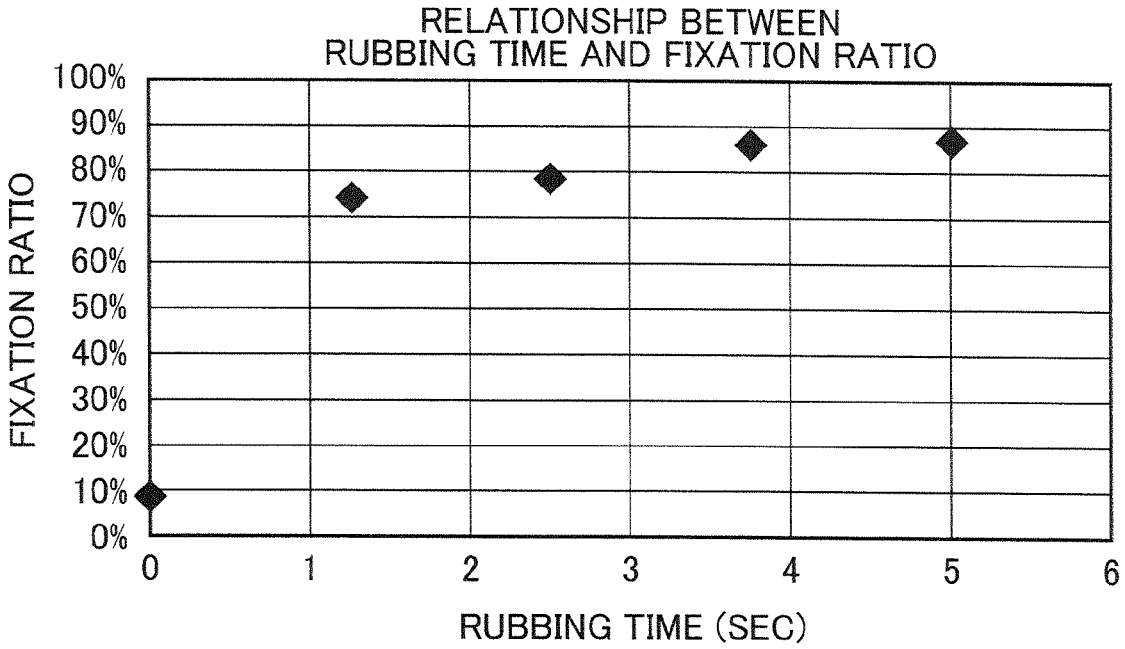
FIG. 3 is a graph schematically showing a relationship between a rubbing/sliding period (rubbing time) on an image layer by a rubbing plate and a fixation ratio of an image layer.

FIG. 3 is a graph schematically showing a fixation ratio of the image layer I against a time period (rubbing time), during which the rubbing plate 200 slides on the image layer I. A relationship between the rubbing time and the fixation ratio is described with reference to FIGS. 2A to 3.

The rubbing time expressed by the horizontal axis of the graph in FIG. 3 indicates a time length during which a given region on the image layer I is in contact with the reciprocating rubbing plate 200.

A fixation ratio FR expressed by the vertical axis of the graph in FIG. 3 is calculated from the following equation, where D0 represents density of the image before peeling a tape attached to the image layer I, and D1 represents density of the image after peeling the tape attached to the image layer I.

$$FR(\%)=D_1/D_0\times 100 \quad \text{[Equation 1]}$$

The tape used for evaluating the fixation ratio FR was Mending Tape produced by 3M. The Mending Tape was attached onto the image layer I by means of a dedicated tool. Therefore, attachment strengths between the image layer I in a test sample and the Mending Tape are kept substantially consistent among data points shown in the graph of FIG. 3. The Mending Tape was pressed to the image layer I of the test sample, and then peeled off from the image layer I at a substantially constant peeling angle and substantially constant peeling speed by means of a dedicated tool.

The image density of the test sample was measured by SpectroEye, which is a spectrophotometer produced by Sakata Inx Eng. Co., Ltd.

As shown in FIG. 3, if the image layer I is rubbed for one second or longer, the image layer I may achieve a relatively high fixation ratio FR. Rubbing the image layer I for less than one second indicates a drastic increase in the fixation ratio FR of the image layer I. It should be noted that a weight of the rubbing plate 200 is appropriately determined such that the surface of the image layer I is not damaged.

Figure 4:
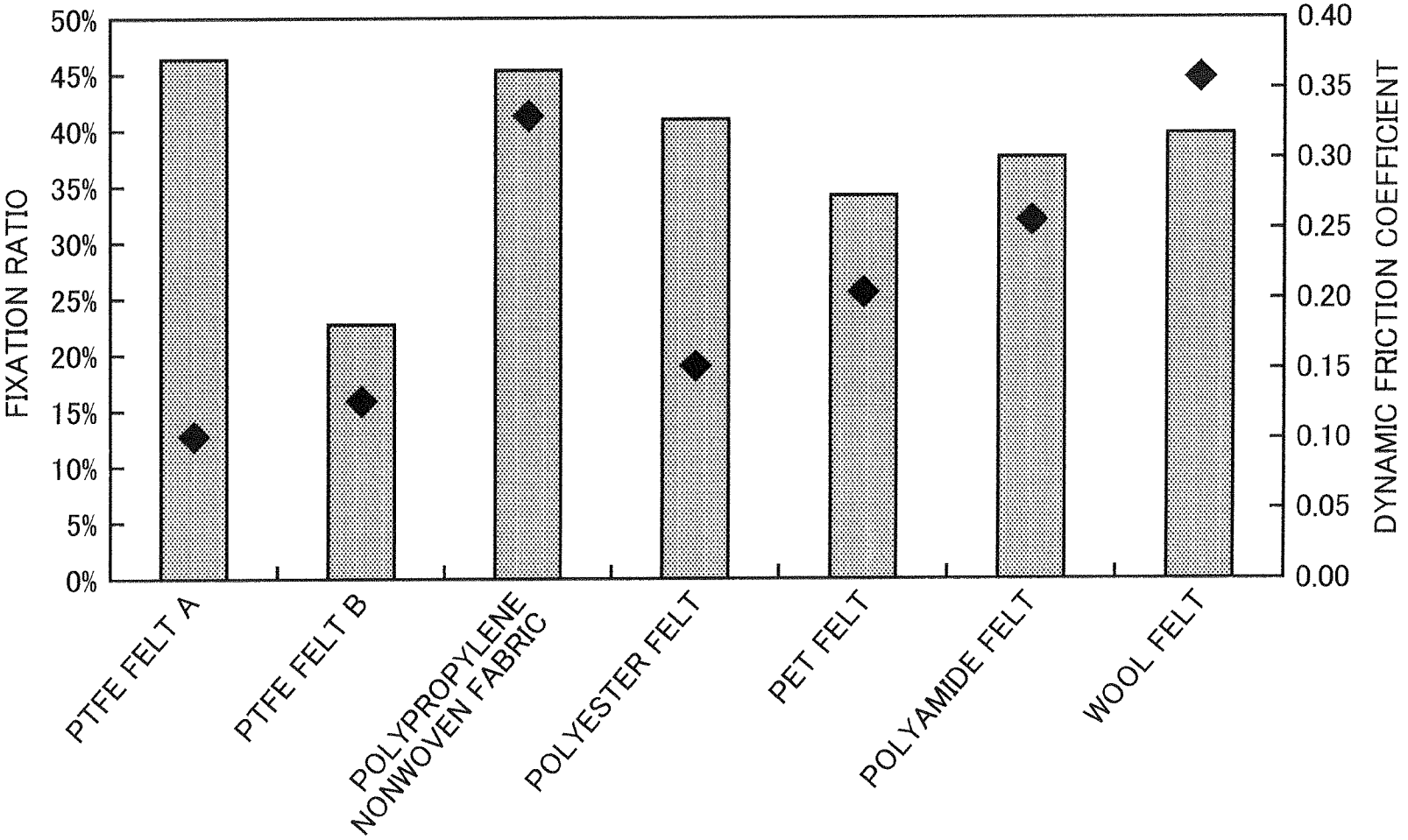
FIG. 4 is a graph schematically showing a relationship between various nonwoven fabrics and fixation ratios.
Figure 5B:
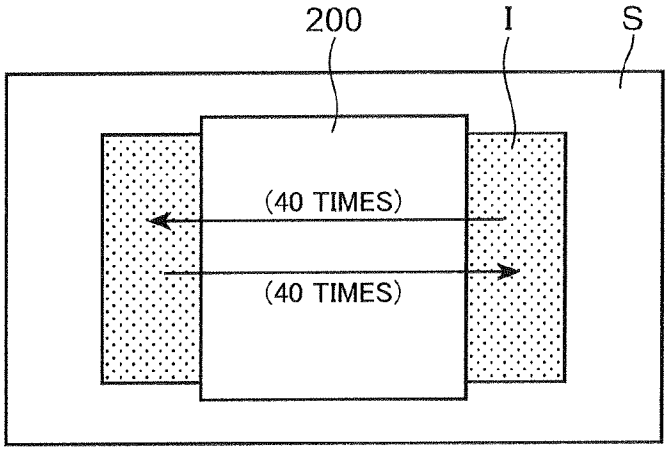
FIGS. 5A to 5D are schematic views respectively showing experimental methods for investigating effects of a number of rubbing directions on the fixation ratio.
Figure 5A:
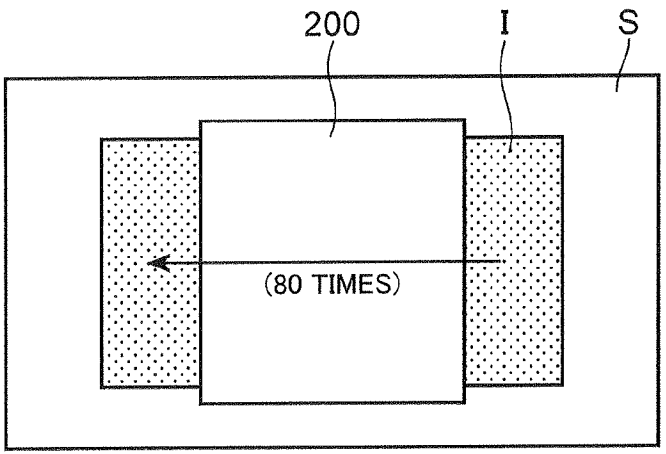
Figure 5D:
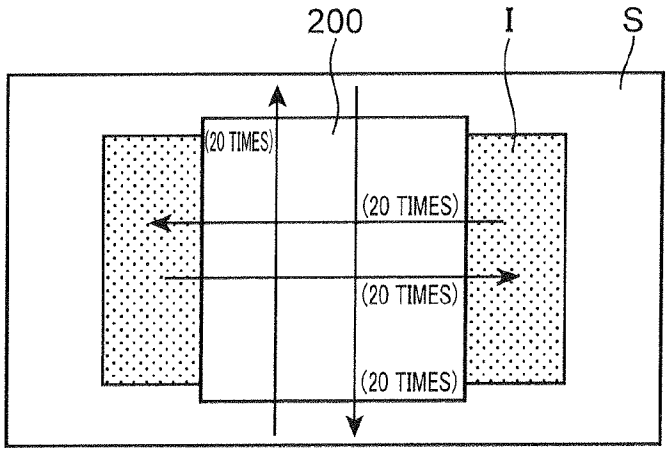
Figure 5C:
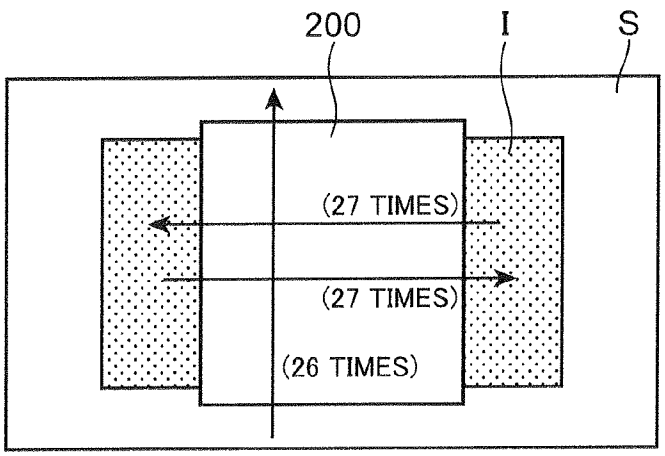

FIG. 4 is a graph schematically showing a relationship between various nonwoven fabrics 220 and the fixation ratios FR. The relationship between the nonwoven fabrics 220 and the fixation ratios FR is described with reference to FIGS. 2A to 4.

The horizontal axis of FIG. 4 represents types of nonwoven fabrics 220. The PTFE felt A, PTFE felt B, polypropylene nonwoven fabric, polyester felt, PET felt, polyamide felt, and wool felt are used in this test.

The left vertical axis of FIG. 4 represents the abovementioned fixation ratios FR. The fixation ratios FR are expressed by bar graphs in FIG. 4. It should be noted that all types of the nonwoven fabrics 220 used in this test achieved high fixation ratios FR in a longer rubbing time than one second. Therefore, the fixation ratios FR shown in FIG. 4 are calculated on the basis of a rubbing time of 0.625 seconds in order to screen out relatively effective types of nonwoven fabrics 220.

The right vertical axis of FIG. 4 represents a dynamic friction coefficient of each nonwoven fabric 220 shown by a dot in FIG. 4. Lower dynamic friction coefficients are advantageous due to less impingement on conveyance of the sheet S and less damage to the image layer I.

As shown in FIG. 4, the PTFE felt A achieves the lowest dynamic friction coefficient and the highest fixation ratio FR. Therefore, it is figured out that the PTFE felt A is the most advantageous among the tested nonwoven fabrics 220. Any nonwoven fabric material, which is not shown in FIG. 4, may be used as the nonwoven fabric 220. Preferably, a nonwoven fabric material with a dynamic friction coefficient of 0.50 or lower is used as the nonwoven fabric 220. It is less likely that such a nonwoven fabric material with the dynamic friction coefficient of 0.50 or lower may impinge on the conveyance of the sheet S and damage to the image layer I.

(Experiment 2)

FIGS. 5A to 5D are schematic views showing experimental methods, respectively, for investigating effects of a number of rubbing directions on the fixation ratios FR. FIGS. 5A to 5D exemplifies experimental conditions according to the present embodiment.

In the present experiment, the sheet S on which the image layer I was formed was prepared. The image layer I was rubbed by the rubbing plate 200 like the experiment 1. The image layer I was rubbed under the four conditions shown in FIGS. 5A to 5D. Other experimental conditions were the same as those described in the context of the experiment.

Under the first experimental condition (FIG. 5A), the image layer I was rubbed in a first experimental direction (from the right to the left). The rubbing was continued for 5 seconds. Meanwhile the image layer I was rubbed 80 times.

In the second experimental condition (FIG. 5B), the image layer I was rubbed in the first experimental direction and a second experimental direction (from the left to the right) opposite to the first experimental direction. The rubbing was continued for 5 seconds in total. The image layer I was rubbed 40 times in the first experimental direction and 40 times in the second experimental direction, respectively.

In the third experimental condition (FIG. 5C), the image layer I was rubbed in the first experimental direction, the second experimental direction and a third experimental direction (from the bottom to the top) perpendicular to the first and second experimental directions. The rubbing was continued for 5 seconds in total. Meanwhile the image layer I was rubbed 27 times in the first and second experimental directions, respectively, and 26 times in the third experimental direction.

In the fourth experimental condition (FIG. 5D), the image layer I was rubbed in the first experimental direction, the second experimental direction, the third experimental direction and a fourth experimental direction (from the top to the bottom) opposite to the third experimental direction. The rubbing was continued for 5 seconds in total. Meanwhile the image layer I was rubbed 20 times in the first to fourth directions, respectively.

Figure 6:
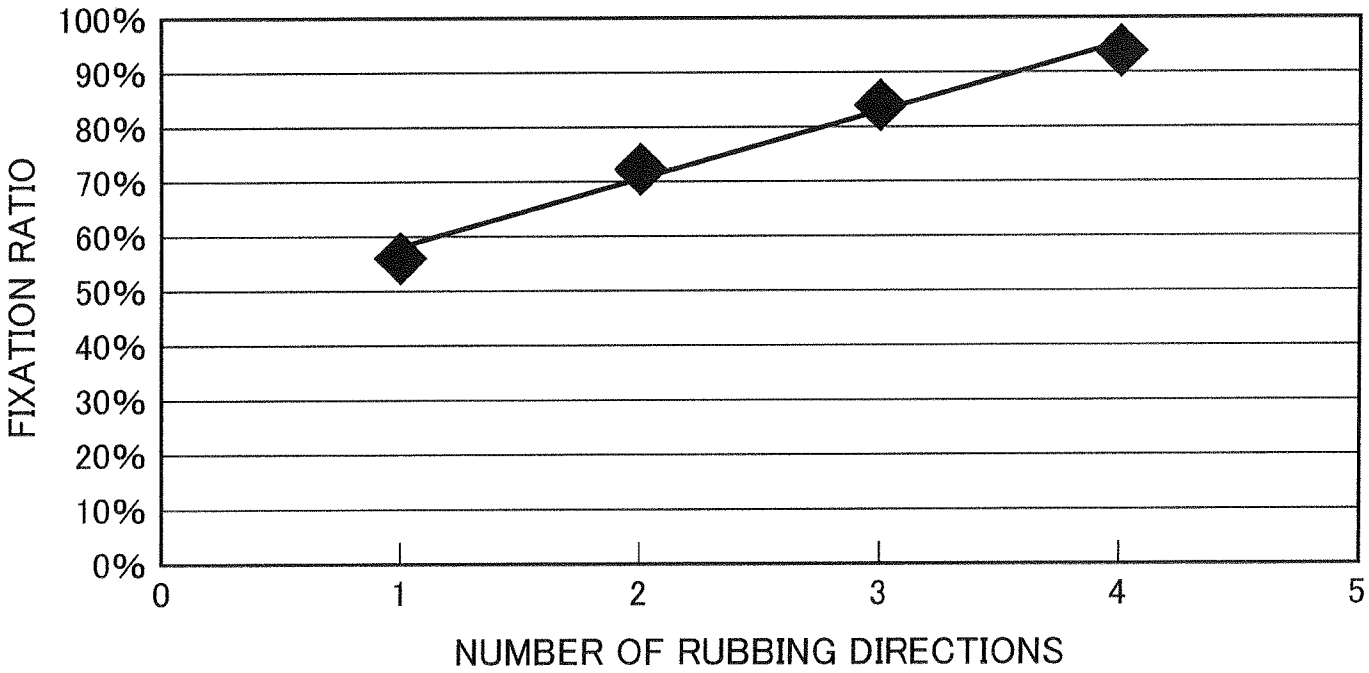
FIG. 6 is a graph showing the fixation ratios obtained under the experimental conditions described with reference to FIGS. 5A to 5D.

FIG. 6 is a graph showing fixation ratios FR obtained under the experimental conditions described with reference to FIGS. 5A to 5D. The horizontal axis of the graph shown in FIG. 6 represents a number of the rubbing directions described with reference to FIGS. 5A to 5D. The vertical axis of the graph shown in FIG. 6 represents the fixation ratios FR of the image layer I on the sheet S. A method for calculating the fixation ratios FR shown in FIG. 6 relies on the calculation method described in the context of the experiment 1. The effects of the number of the rubbing directions on the fixation ratios FR are described with reference to FIGS. 5A to 6.

As shown in FIG. 6, the fixation ratio FR linearly went up as an increase in the number of rubbing directions. Under the first experimental condition described with reference to FIG. 5A, the fixation ratio FR was 56%. Under the second experimental condition described with reference to FIG. 5B, the fixation ratio FR was 73%. Under the third experimental condition described with reference to FIG. 5C, the fixation ratio FR was 84%. Under the fourth experimental condition described with reference to FIG. 5D, the fixation ratio FR was 94%.

It is clear from the graph shown in FIG. 6 that the increase in the number of the rubbing directions causes a high fixation ratio FR in a relatively short period of time.

<Liquid Developer>

The aforementioned fixing principles are preferably applied to an image formed by means of the following liquid developer. Various components of the liquid developer are described below. As described later, fixing properties of the liquid developer depend on the components of the liquid developer.

The liquid developer includes the electrically insulating carrier liquid C and the colored particles P dispersed in the carrier liquid C. This liquid developer also contains the polymer compounds R. The liquid developer preferably has viscosity of 30 to 400 mPa·s at a measurement temperature of 25° C. The viscosity of the liquid developer (at the measurement temperature of 25° C.) is preferably 40 to 300 mPa·s, and more preferably 50 to 250 mPa·s.

(Carrier Liquid)

The electrically insulating carrier liquid C which works as liquid carrier enhances electrical insulation of the liquid developer. For example, electrically insulating organic solvent having a volume resistivity of 1012 Ω·cm or above at 25° C. (i.e., an electrical conductivity of 1.0 pS/cm or lower) is preferably used as the electrically insulating carrier liquid C. In addition, carrier liquid, which may further dissolve the following polymer compounds R, is preferably used (the one with relatively high solubility for the polymer compounds R).

The viscosity and type of the carrier liquid C as well as the compounding amount therein are appropriately adjusted and selected in order to obtain the 30 to 400 mPa·s viscosity (at the measuring temperature of 25° C.) in the entire liquid developer. The viscosity of the liquid developer depends on a combination of the organic solvent used as the carrier liquid C and the organic polymer compounds R, which is described hereinafter. Therefore, the type and compounding amount of the organic solvent are appropriately determined in response to desired viscosity of the liquid developer and a selected type of polymer compounds R.

Aliphatic hydrocarbons and vegetable oil, which are liquid at an ordinary temperature, are exemplified as the electrically insulating organic solvent.

Liquid n-paraffinic hydrocarbons, iso-paraffinic hydrocarbons, halogenated aliphatic hydrocarbons, branched aliphatic hydrocarbons, and a mixture thereof are exemplified as the aliphatic hydrocarbons. For example, n-hexane, n-heptane, n-octane, nonane, decane, dodecane, hexadecane, heptadecane, cyclohexane, perchloroethylene, trichloroethane, and alike may be used as the aliphatic hydrocarbons. Nonvolatile organic solvent and organic solvent of relatively low volatility (e.g., with a boiling point of 200° C. or higher) are preferred in terms of environmental responsiveness (VOC measures). In addition, liquid paraffins which include a relatively large amount of aliphatic hydrocarbon with 16 or more carbon atoms may be preferably used.

Tall oil fatty acid (major components: oleic acid, linoleic acid), vegetable oil-based fatty acid ester, soybean oil, sunflower oil, castor oil, flaxseed oil, and tung oil are exemplified as the vegetable oil. The tall oil fatty acid and alike among them are preferably used. In the following evaluation of the fixing properties, medium-chain triglyceride "Coconard MT" produced by Kao Corporation is used as vegetable oil.

Liquid paraffins "Moresco White P-55", "Moresco White P-40", "Moresco White P-70", and "Moresco White P-200" manufactured by Matsumura Oil Co., Ltd.; tall oil fatty acids "Hartall FA-1", "Hartall FA-1P", and "Hartall FA-3" manufactured by Harima Chemicals, Inc.; vegetable oil-based solvents "Vege-Sol™ MT", "Vege-Sol™ CM", "Vege-Sol™ MB", "Vege-Sol™ PR", and tung oil manufactured by Kaneda Co., Ltd.; "Isopar™ G", "Isopar™ H", "Isopar™ K", "Isopar™ L", "Isopar™ M", and "Isopar™ V" manufactured by ExxonMobil Corporation; liquid paraffins "Cosmo White P-60", "Cosmo White P-70", and "Cosmo White P-120" manufactured by Cosmo Oil Co., Ltd.; vegetable oils "refined soybean oil S", "flaxseed oil", and "sunflower oil" manufactured by The Nisshin Oillio Group, Ltd.; and "castor oil LAV" and "castor oil I" manufactured by Ito Oil Chemicals Co., Ltd. are exemplified as the carrier liquid C.

Any carrier liquid C may be used as long as it dissolves the polymer compounds R. In other words, the one with relatively high solubility for the polymer compounds R (the one which dissolves the polymer compounds R successfully) may be used alone as the carrier liquid C, or it may be combined with the one with relatively low solubility for the polymer compounds R (the one that poorly dissolves the polymer compounds R). It should be noted that electrical conductivity of the entire carrier liquid C (the electrical conductivity of the liquid developer) is adjusted according to a type of the carrier liquid C so that the electrical conductivity of the liquid developer does not becomes excessively high. For instance, vegetable oils such as tall oil fatty acids generally have higher electrical conductivity than the aliphatic hydrocarbons such as liquid paraffins. Therefore, if the aforementioned vegetable oils are included as the carrier liquid C in order to successfully dissolve the polymer compounds R in the carrier liquid C, the electrical conductivity should be carefully adjusted.

Carrier liquid C which has a greater amount of the aforementioned oil is more advantageous in terms of the solubility for the polymer compounds R whereas it may be disadvantageous in terms of the electrical conductivity. Carrier liquid C which has a fewer amount of the aforementioned oil is more advantageous in terms of the electrical conductivity whereas it may be disadvantageous in terms of the solubility for the polymer compounds R.

As described above, contents of the aforementioned oils in the entire carrier liquid C depends on types and contents of the polymer compounds R contained in the liquid developer, and are preferably, for example, 2 to 80 mass %, and more preferably 5 to 60 mass %. It becomes difficult to successfully dissolve the polymer compounds R in the carrier liquid C if contents of the oils is less than 2 mass %. The electrical conductivity of the entire carrier liquid C and the liquid developer becomes excessively high if the contents of the oils exceeds 80 mass %. The excessively high electrical conductivity of the liquid developer leads to low image density.

The electrical conductivity of the liquid developer is preferably, for example, 200 pS/cm or lower. Therefore, the electrical conductivity of the entire carrier liquid C (the electrical conductivity of the liquid developer) is preferably adjusted to, for example, 200 pS/cm or lower by mixing a highly electrically resistant aliphatic hydrocarbon with resultant solution from dissolving the polymer compounds R in the oils such as tall oil fatty acids (often referred to as "resin solvent" hereinafter).

(Colored Particles)

In this embodiment, pigment is used as colored particles P. The liquid developer containing the pigment enables the aforementioned non-heating fixing process. As a result, the pigment as the colored particles P is fixed to a recording medium with little heat and light energies.

For example, known organic or inorganic pigment may be used for the pigment according to the present embodiment in non-limiting manner.

For example, conventionally known organic pigment or inorganic pigment may be used as the pigment of the present embodiment without any limitation. Azine dyes such as carbon black, oil furnace black, channel black, lampblack, acetylene black, and aniline black, metal salt azo dyes, metallic oxides, and combined metal oxides are exemplified as black pigment. Pigment Yellow 74, Cadmium yellow, mineral fast yellow, nickel titanium yellow, navels yellow, naphthol yellow S, hansa yellow G, hansa yellow 10G, benzidine yellow GR, quinoline yellow lake, permanent yellow NCG, and tartrazine lake are exemplified as yellow pigment. Molybdenum orange, permanent orange GTR, pyrazolone orange, Vulcan orange, indanthrene brilliant orange RK, benzidine orange G, and indanthrene brilliant orange GK are exemplified as orange pigment. Pigment Red 57:1, Colcothar, cadmium red, permanent red 4R, lithol red, pyrazolone red, watching red calcium salt, lake red D, brilliant carmine 6B, eosin lake, rhodamine lake B, alizarin lake, and brilliant carmine 3B are exemplified as red pigment. Fast violet B and methyl violet lake are exemplified as purple pigment. C.I. Pigment Blue 15:3, cobalt blue, alkali blue, Victoria blue lake, phthalocyanine blue, non-metal phthalocyanine blue, partial chloride of phthalocyanine blue, fast sky blue, and indanthrene blue BC are exemplified as blue pigment. Chrome green, chromium oxide, pigment green B, and malachite green lake are exemplified as green pigment.

Contents of each pigment in the liquid developer are preferably 1 to 30 mass %, more preferably 3 mass % or more, and more preferably 5 mass % or more. The contents of each pigment are also more preferably 20 mass % or less, and more preferably 10 mass % or less.

An average particle diameter of each pigment in the liquid developer, which is a volume basis median diameter (D50), is preferably 0.1 to 1.0 μm. The average particle diameter less than 0.1 μm leads to, for example, low image density. The average particle diameter above 1.0 μm leads to, for example, low fixation properties. The volume basis median diameter (D50) here generally denotes a particle diameter at the point where a cumulative curve based on the total volume 100% of one group of particles with a determined particle distribution attains 50%.

(Dispersion Stabilizer)

The liquid developer according to the present embodiment may contain dispersion stabilizer for facilitating and stabilizing dispersion of the particles in the liquid developer. Dispersion stabilizer "BYK-116" manufactured by BYK Co., Ltd., for example, may be suitably used as the dispersion stabilizer according to the present embodiment. In addition, "Solsperse 9000," "Solsperse 11200," "Solsperse 13940," "Solsperse 16000," "Solsperse 17000, and "Solsperse 18000" manufactured by The Lubrizol Corporation, and "Antaron™ V-216" and "Antaron™ V-220" manufactured by International Specialty Products, Inc. may be preferably used.

Contents of the dispersion stabilizer in the liquid developer are approximately 1 to 10 mass %, and preferably approximately 2 to 6 mass %.

(Polymer Compounds)

The polymer compounds R contained in the liquid developer according to the present embodiment are organic polymer compounds such as cyclic olefin copolymer, styrene elastomer, cellulose ether and polyvinyl butyral. A material which increases viscosity of the liquid developer to prevent bleeding during the image formation may be selected as the organic polymer compounds with high solubility for the carrier liquid C. A cyclic olefin copolymer, styrene elastomer, cellulose ether, and polyvinyl butyral are exemplified as the organic polymer compounds. Preferably, styrene elastomer is used as the organic polymer compounds. A single type of organic polymer compound or several types of organic polymer compounds may be used as the polymer compounds R.

The liquid developer of the present embodiment contains the polymer compounds dissolved in the carrier liquid C. The organic polymer compounds dissolved in the carrier liquid C may be gel-like polymer compounds. Depending on types and molecular weights of the organic polymer compounds, the organic polymer compounds are mutually entwined in the carrier liquid C and form gel. The gel-like organic polymer compounds have a low fluidity. For example, if concentration of the organic polymer compounds is high or if affinity of the organic polymer compounds for the carrier liquid C is low or if the ambient temperature is low, the organic polymer compounds are likely to form gel. On the other hand, the organic polymer compounds, which hardly entwine mutually in the carrier liquid C, become flowable solution.

Contents of the organic polymer compounds in the liquid developer are appropriately determined according to a type of the organic polymer compounds. The contents of the organic polymer compounds are preferably, for example, 1 to 10 mass %.

If the contents of the polymer compounds are less than 1 mass %, sufficient viscosity may not be obtained in the liquid developer, which may ineffectively prevent bleeding during the image formation. The contents of the polymer compounds exceeding 10 mass % leads to formation of an excessively thick film of the organic polymer compounds on the surface of the sheet S, which significantly deteriorates drying characteristics of the film, increases adherence (tackiness) of the film, and worsens scratch resistance of the image.

The organic polymer compounds which may be preferably used in the present embodiment are described hereinafter in more detail.

(Cyclic Olefin Copolymer)

Cyclic olefin copolymer is amorphous, thermoplastic cyclic olefin resin which has a cyclic olefin skeleton in its main chain without environmental load substances and is excellent in transparency, lightweight properties, and low water absorption properties. The cyclic olefin copolymer of the present embodiment is an organic polymer compound with a main chain composed of a carbon-carbon bond, in which at least a part of the main chain has a cyclic hydrocarbon structure. The cyclic hydrocarbon structure is introduced by using, as a monomer, a compound having at least one olefinic double bond in the cyclic hydrocarbon structure (cyclic olefin), such as norbornene and tetracyclododecene.

Examples of the cyclic olefin copolymer that may be used in the present embodiment include (1) cyclic olefin-based addition (co)polymer or its hydrogenated product, (2) an addition copolymer of a cyclic olefin and an α-olefin, or its hydrogenated product, and (3) a cyclic olefin-based ring-opening (co)polymer or its hydrogenated product.

Specific examples of the cyclic olefin copolymer are as follows:

(a) Cyclopentene, cyclohexane, cyclooctene;

(b) Cyclopentadiene, 1,3-cyclohexadiene and other one-ring cyclic olefins;

(c) Bicyclo[2.2.1]hept-2-ene (norbornene), 5-methyl-bicyclo[2.2.1]hept-2-ene, 5,5-dimethyl-bicyclo[2.2.1]hept-2-ene, 5-ethyl-bicyclo[2.2.1]hept-2-ene, 5-butyl-bicyclo[2.2.1]hept-2-ene, 5-ethylidene-bicyclo[2.2.1]hept-2-ene, 5-hexyl-bicylo[2.2.1]hept-2-ene, 5-octyl-bicyclo[2.2.1]hept-2-ene, 5-octadecyl-bicylo[2.2.1]hept-2-ene, 5-methylidene-bicyclo[2.2.1]hept-2-ene, 5-vinyl-bicyclo[2.2.1]hept-2-ene, 5-propenyl-bicyclo[2.2.1]hept-2-ene, and other two-ring cyclic olefins;

(d) Tricyclo[4.3.0.12,5]deca-3,7-diene (dicyclopentadiene), tricyclo[4.3.0.12,5]deca-3-ene;

(e) Tricyclo[4.4.0.12,5]undeca-3,7-diene or tricyclo[4.4.0.12,5]undeca-3,8-diene or tricyclo[4.4.0.12,5]undeca-3-ene that is a partially hydrogenated product (or an adduct of cyclopentadiene and cyclohexane) thereof;

(f) 5-cyclopentyl bicyclo[2.2.1]hept-2-ene, 5-cyclohexyl-bicyclo[2.2.1]hept-2-ene, 5-cyclohexenyl bicyclo[2.2.1]hept-2-ene, 5-phenyl-bicyclo[2.2.1]hept-2-ene, and other three-ring cyclic olefins;

(g) Tetracyclo[4.4.0.12,5.17,10]dodeca-3-ene (tetracyclododecene), 8-methyltetracyclo[4.4.0.12,5.17,10]dodeca-3-ene, 8-ethyltetracyclo[4.4.0.12,5.17,10]dedeca-3-ene, 8-methylidenetetracyclo[4.4.0.12,5.17,10]dodeca-3-ene, 8-ethylidenetetracyclo[4.4.0.12,5.17,10]dodeca-3-ene, 8-vinyltetracyclo[4.4.0.12,5.17,10]dodeca-3-ene, 8-propenyl-tetracyclo[4.4.0.12,5.17,10]dodeca-3-ene, and other four-ring cyclic olefins;

(h) 8-cyclopentyl-tetracyclo[4.4.0.12,5.17,10]dodeca-3-ene, 8-cyclohexyl-tetracyclo[4.4.0.12,5.17,10]dodeca-3-ene, 8-cyclohexenyl-tetracyclo[4.4.0.12,5.17,10]dodeca-3-ene, and 8-phenyl-cyclopentyl-tetracyclo[4.4.0.12,5.17,10]dodeca-3-ene;

(i) Tetracyclo[7.4.13,6.01,9.02,7]tetradeca-4,9,11,13-tetraene (1,4-methano-1,4,4a,9a-tetrahydrofluorene), tetracyclo[8.4.14,7.01,10.03,8]pentadeca-5,10,12,14-tetraene (1,4-methano-1,4,4a,5,10,10a-hexahydroanthracene);

(j) Pentacyclo[6.6.1.13,6.02,7.09,14]-4-hexadecene, pentacyclo[6.5.1.13,6.02,7.09,13]-4-pentadecene, pentacyclo[7.4.0.02,7.13,6.110,13]-4-pentadecene, heptacyclo[8.7.0.12,9.14,7.111,17.03,8.012,16]-5-eicosene, heptacyclo[8.7.0.12,9.03,8.14,7.012,17.113,16]-14-eicosene; and (k) Polycyclic olefins such as tetramers of cyclopentadiene. These cyclic olefins may be used alone or in combinations of two or more thereof.

An α-olefin having 2 to 20 carbon atoms, and preferably 2 to 8 carbon atoms is preferable for the abovementioned α-olefin. Specific examples thereof include ethylene, propylene, 1-butene, 1-pentene, 1-hexene, 3-methyl-1-butene, 3-methyl-1-pentene, 3-ethyl-1-pentene, 4-methyl-1-pentene, 4-methyl-1-hexene, 4,4-dimethyl-1-hexene, 4,4-dimethyl-1-pentene, 4-ethyl-1-hexene, 3-ethyl-1-hexene, 1-octene, 1-decene, 1-dodecene, 1-tetradecene, 1-hexadecene, 1-octadecene, and 1-eicosene. These α-olefins may be used alone or in combinations of two or more thereof.

A method for polymerizing cyclic olefins, a method for polymerizing cyclic olefins with α-olefins, and a method for hydrogenating the resultant polymer are not particularly limited and may be carried out according to well-known methods.

The structure of the cyclic olefin copolymer is not particularly limited and may be linear, branched or crosslinked. The linear cyclic olefin copolymer may be preferable.

A copolymer of norbornene and ethylene, or of tetracyclododecene and ethylene may be preferably used as the cyclic olefin copolymer. Copolymer of norbornene and ethylene is more preferred. In this case, contents of norbornene in the copolymer is preferably 60 to 82 mass %, more preferably 60 to 79 mass %, yet more preferably 60 to 76 mass %, and most preferably 60 to 65 mass %. If the contents of norbornene is less than 60 mass %, a glass transition temperature of the cyclic olefin copolymer film may become excessively low, which may lead to a risk of lowering film formation properties of the cyclic olefin copolymer. If the contents of norbornene exceeds 82 mass %, the glass transition temperature of the cyclic olefin copolymer film may become excessively high, which may lead to a risk of lowering fixation properties of pigment, that is, fixation properties of images by the film of the cyclic olefin copolymer. Or the solubility of the cyclic olefin copolymer for the carrier liquid C may be reduced.

In this embodiment, a commercially available cyclic olefin copolymer may be used. Examples of the copolymer of norbornene and ethylene include "TOPAS™ TM" (norbornene content: approximately 60 mass %), "TOPAS™ TB" (norbornene content: approximately 60 mass %), "TOPAS™ 8007" (norbornene content: approximately 65 mass %), "TOPAS™ 5013" (norbornene content: approximately 76 mass %), "TOPAS™ 6013" (norbornene content: approximately 76 mass %), "TOPAS™ 6015" (norbornene content: approximately 79 mass %), and "TOPAS™ 6017" (norbornene content: approximately 82 mass %), which are manufactured by TOPAS Advanced Polymers GmbH. These copolymers may be used alone or in combinations of two or more thereof, depending on the circumstances.

(Styrene Elastomer)

A conventionally known styrene elastomer may be used as the polymer compounds R in the present embodiment without any restrictions. Specific examples thereof include a block copolymer composed of an aromatic vinyl compound and a conjugated diene compound or olefinic compound. Examples of the block copolymer include a block copolymer that has a structure expressed by Chemical Formula 1 where A is a polymer block composed of an aromatic vinyl compound and B is a polymer block composed of an olefinic compound or a conjugated diene compound.

[C1]

(Chemical Formula 1)

$$[A—B]_x—A$$

(Where x represents an integer chosen such that the number molecular average weight ranges from 1,000 to 100,000.)

Examples of the aromatic vinyl compound constituting the aforementioned block copolymer include styrene, α-methylstyrene, o-methylstyrene, m-methylstyrene, p-methylstyrene, 2,3-dimethylstyrene, 2,4-dimethylstyrene, monochlorostyrene, dichlorostyrene, p-bromostyrene, 2,4,5-tribromostyrene, 2,4,6-tribromostyrene, o-tert-butylstyrene, m-tert-butylstyrene, p-tert-butylstyrene, ethylstyrene, vinylnaphthalene, and vinylanthracene.

The polymer block A may be composed of one or two or more types of the aforementioned aromatic vinyl compounds. The one composed of styrene and/or α-methylstyrene among these aromatic vinyl compounds provides suitable properties for the liquid developer of the present embodiment.

Examples of the olefinic compound constituting the aforementioned block copolymer include ethylene, propylene, 1-butene, 2-butene, isobutene, 1-pentene, 2-pentene, cyclopentene, 1-hexene, 2-hexene, cyclohexene, 1-heptene, 2-heptene, cycloheptene, 1-octene, 2-octene, cyclooctene, vinylcyclopentene, vinylcyclohexene, vinylcycloheptene, and vinylcyclooctene.

Examples of the conjugated diene compound constituting the block copolymer include butadiene, isoprene, chloroprene, 2,3-dimethyl-1,3-butadiene, 1,3-pentadien, and 1,3-hexadien.

The polymer block B may be composed of one or two or more types of each of the olefinic compounds and the conjugated diene compounds. The one composed of butadiene and/or isoprene among these compounds provides suitable properties for the liquid developer of the present embodiment.

Specific examples of the aforementioned block copolymer include a polystyrene-polybutadiene-polystyrene triblock copolymer or its hydrogenated product, polystyrene-polyisoprene-polystyrene triblock copolymer or its hydrogenated product, polystyrene-poly(isoprene/butadiene)-polystyrene triblock copolymer or its hydrogenated product, poly(α-methylstyrene)-polybutadiene-poly(α-methylstyrene)triblock copolymer or its hydrogenated product, poly(α-methylstyrene)-polyisoprene-poly(α-methylstyrene)triblock copolymer or its hydrogenated product, poly(α-methylstyrene)-poly(isoprene/butadiene)-poly(α-methylstyrene)triblock copolymer or its hydrogenated product, polystyrene-polyisobutene-polystyrene triblock copolymer, and poly(α-methylstyrene)-polyisobutene-poly(α-methylstyrene)triblock copolymer.

It is preferred to use a styrene-butadiene elastomer (SBS) with a structure, in which the polymer block A and polymer block B are expressed by Chemical Formula 2, as the styrene elastomer.

[C2]

(Chemical Formula 2)

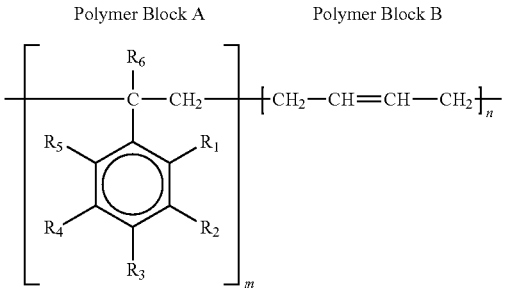

(where $R_1$, $R_2$, $R_4$, $R_5$ and $R_6$ each represent a hydrogen atom or methyl group; $R_3$ represents a hydrogen atom, a halogen atom, a phenyl group or a saturated alkyl group, a methoxy group or ethoxy group having 1 to 20 carbon atoms; and m, n each represent an integer chosen such that the content of the polymer block A ranges from 5 to 75 mass %.)

The styrene-butadiene elastomer is obtained by copolymerizing styrene monomer and butadiene, which is the conjugated diene compound. Examples of preferred styrene monomer include styrene, α-methylstyrene, o-methylstyrene, m-methylstyrene, p-methylstirene, p-ethylstyrene, 2,4-dimethylstyrene, p-n-butylstyrene, p-dodecylstyene, p-methoxystyrene, p-phenylstyrene, and p-chlorostyrene.

The aforementioned styrene-butadiene elastomer has a number average molecular weight Mn in a range of, preferably, 1,000 to 100,000 (c.f., Chemical Formula 1) and more preferably 2,000 to 50,000, in a molecular weight distribution measured by means of a GPC (gel permeation chromatography). A weight-average molecular weight Mw of the styrene-butadiene elastomer is in a range of, preferably, 5,000 to 1,000,000 and more preferably 10,000 to 500,000. In this case, at least one peak is present in the weight-average molecular weight Mw range of 2,000 to 200,000 and preferably in the weight-average molecular weight Mw range of 3,000 to 150,000.

In the aforementioned styrene-butadiene elastomer, a value of ratio (weight-average molecular weight Mw/number average molecular weight Mn) may be preferably equal to or lower than 3.0, and more preferably equal to or lower than 2.0.

Contents of styrene in the aforementioned styrene-butadiene elastomer (the contents of the polymer block A) are in a range of, preferably, 5 to 75 mass % (c.f., Chemical Formula 2) and more preferably 10 to 65 mass %. If the styrene contents are less than 5 mass %, a glass transition temperature of the styrene elastomer film becomes excessively low and deteriorates the film formation properties of the styrene elastomer. If the styrene contents exceed 75 mass %, a softening point of the styrene elastomer film becomes excessively high and worsens fixation properties of pigment, that is, fixation properties of images due to the styrene elastomer film.

In the present embodiment, a commercially available styrene elastomer may be used. For example, "Klayton" manufactured by Shell, "Asaprene™" T411, T413, T437, "Tufprene™" A, 315P, which are manufactured by Asahi Kasei Chemicals Corporation, and "JSR TR1086," "JSR TR2000," "JSR TR2250" and "JSR TR2827" manufactured by JSR Corporation, may be used as a styrene-conjugated diene block copolymer. "Septon" S1001, S2063, S4055, S8007, "Hybrar" 5127, 7311, which are manufactured by Kuraray Co., Ltd., "Dynaron" 6200P, 4600P, 1320P manufactured by JSR Corporation may be used as a hydrogenated product of the styrene-conjugated diene block copolymer. Also, "Index" manufactured by The Dow Chemical Company may be used as styrene-ethylene copolymer. As other styrene elastomers, "Aron AR" manufactured by Aronkasei Co., Ltd. and "Rabalon" manufactured by Mitsubishi Chemical Corporation may be used. These materials may be used alone or in combinations of two or more types thereof as appropriate.

(Cellulose Ether)

Cellulose ether is a polymer formed by substituting a hydroxyl group of a cellulose molecule with an alkoxy group. The substitution rate is preferably 45 to 49.5%. The alkyl moiety of the alkoxy group may be substituted with, for example, hydroxyl group or alike. A film formed by cellulose ether is excellent in toughness and thermal stability.

Examples of the cellulose ether which may be used in the present embodiment include: alkyl cellulose such as methylcellulose and ethylcellulose; hydroxyalkyl cellulose such as hydroxyethyl cellulose and hydroxypropyl cellulose; hydroxy alkyl alkyl cellulose such as hydroxyethyl methyl cellulose, hydroxypropyl methyl cellulose, and hydroxyethyl ethyl cellulose; carboxy alkyl cellulose such as carboxymethyl cellulose; and carboxy-alkyl hydroxy-alkyl cellulose such as carboxymethyl hydroxyethyl cellulose. These cellulose ethers may be used alone or in combinations of two or more thereof. Alkyl celluloses are preferred among these cellulose ethers. Ethyl celluloses are preferred among these alkyl celluloses.

In the present embodiment, commercially available cellulose ether may be used. Examples of the ethylcellulose include "Ethocel™ STD4," "Ethocel™ STD7," and "Ethocel™ STD10" manufactured by Nissin-Kasei Co., Ltd. These ethyl celluloses may be used alone or in combinations of two or more thereof, depending on the circumstances.

(Polyvinyl Butyral)

As shown in Chemical Formula 3, the polyvinyl butyral (butyral resin: alkyl acetalized polyvinyl alcohol) is a copolymer of a hydrophilic vinyl alcohol unit having a hydroxyl group, a hydrophobic vinyl acetal unit having a butyral group, and a vinyl acetate unit having intermediate properties between a vinyl alcohol unit and vinyl acetal unit and having an acetyl group. Polyvinyl butyral which has a degree of butyralization (the ratio between a hydrophilic moiety and a hydrophobic moiety) between 60 to 85 mol % is preferred in the liquid developer of the present embodiment in terms of its excellent film formation properties (film formation properties). The polyvinyl butyral has a vinyl acetal unit indicating the solubility of the polyvinyl butyral for nonpolar solvent and a vinyl alcohol unit for improving the bonding properties of the recording medium such as paper. Therefore, the polyvinyl butyral has high affinity with both the carrier liquid C and the recording medium.

[C3]

(Chemical Formula 3)

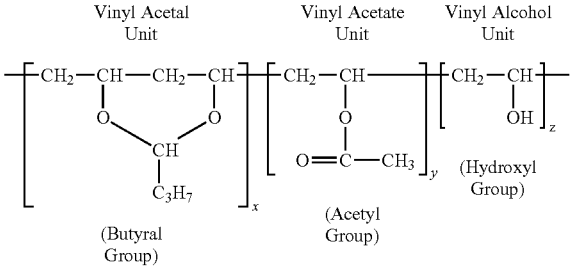

"Mowital™" B20H, B30B, B30H, B60T, B60H, B60HH and B70H manufactured by Hoechst AG; "S-LEC™" BL-1 (degree of butyralization: 63±3 mol %), BL-2 (degree of butyralization: 63±3 mol %), BL-S (degree of butyralization: 70 mol % or more), BL-L, BH-3 (degree of butyralization: 65±3 mol %), BM-1 (degree of butyralization: 65±3 mol %), BM-2 (degree of butyralization: 68±3 mol %), BM-5 (degree of butyralization: 63±3 mol %) and BM-S, manufactured by Sekisui Chemical Co., Ltd.; and "Denka butyral" #2000-L, #3000-1, #3000-2, #3000-3, #3000-4, #3000-K, #4000-1, #5000-A, and #6000-C manufactured by Denki Kagaku Kogyo KK may be exemplified as the polyvinyl butyral. These polyvinyl butyrals may be used alone or in combinations of two or more thereof.

(Manufacturing Method)

The liquid developer according to the present embodiment may be produced by sufficiently dissolving or mixing/dispersing the carrier liquid C, pigment, polymer compounds and optionally the dispersion stabilizer for several minutes to over 10 hours, as appropriate, by using, for example, a ball mill, sand grinder, Dyno mill, rocking mill or alike (or a media distributed machine using zirconia beads and alike may be used).

Mixing/dispersing these components finely pulverize the pigment. The mixing/dispersion time and the rotating speed of the machine are adjusted so that the average particle diameter (D50) of the pigment in the liquid developer becomes, preferably, 0.1 to 1.0 μm as described above. If the dispersion time is excessively short or if the rotating speed is excessively low, the average particle diameter of the pigment (D50) exceeds 1.0 μm, and deteriorates the fixation properties as described above. If the dispersion time is excessively long or if the rotating speed is excessively high, the average particle diameter of the pigment (D50) becomes less than 0.1 μm, which in turn leads to poor developing properties and low image density.

The liquid developer may be produced by dissolving the polymer compounds in the carrier liquid C and then mixing/dispersing the pigment (with the dispersion stabilizer, as appropriate). The liquid developer may be produced by preparing solution obtained by dissolving the polymer compounds in the carrier liquid C and a pigment dispersion (obtained by mixing/dispersing the pigment in the carrier liquid C (with the dispersion stabilizer, as appropriate)), and then mixing the resin solution with the pigment dispersion at an appropriate mixing ratio (mass ratio).

A particle size distribution needs to be measured in order to calculate the average particle diameter (D50) of the pigment. The particle size distribution of the pigment may be measured as follows.

A given amount of produced liquid developer or prepared pigment dispersion is sampled and diluted to 10 to 100 times of its volume with the same carrier liquid C as the one used in the liquid developer or the pigment dispersion. The particle size distribution of the resultant liquid is measured on the basis of a flow system using a laser diffraction type particle size distribution measuring device "Mastersizer 2000" manufactured by Malvern Instruments Ltd.

The viscosity of the produced liquid developer may be measured at a measurement temperature of 25° C. by using a vibrational viscometer "Viscomate VM-10A-L" manufactured by CBC Co., Ltd.

<Evaluation of Fixing Properties>

The present inventors evaluated the fixing properties of the aforementioned various types of liquid developer, which were preferably fixed under the principle of the fixing technologies described with reference to FIGS. 1A to 6. Generally, an image forming apparatus for forming a color image uses cyan liquid developer, yellow liquid developer and magenta liquid developer. Thus, the present inventors prepared three liquid developers having these hues and evaluated the fixing properties of the liquid developers.

(Cyan Liquid Developer)

Styrene-butadiene elastomer (1.33 mass parts: "Asaprene (registered trademark) T-413" produced by Asahi Kasei Chemicals Corporation: styrene content of 30 mass %) was prepared as polymer compounds. Vegetable oil (98.67 mass parts: medium-chain triglyceride "Coconard MT" produced by Kao Corporation) was prepared as solvent for dissolving the polymer compounds. The polymer compounds were dissolved in the vegetable oil to prepare resin solution.

Liquid paraffin (72 mass parts: "Moresco White P-200" produced by Matsumura Oil Co., Ltd.) was prepared as carrier liquid. "Antaron (registered trademark) V-216" (8 mass parts) produced by ISP Chemicals was prepared as dispersion stabilizer. Cyan pigment (20 mass parts: C. I. Pigment blue 15:3) was prepared as the colored particles. The carrier liquid, the dispersion stabilizer and the polymer compounds were mixed and dispersed for 1 hour by means of a rocking mill (RM-10 produced by Seiwa Giken Co, Ltd.) to obtain pigment dispersion. It should be noted that a drive frequency of the rocking mill was 60 Hz. An average particle diameter (D50) of the pigment in the pigment dispersion was 0.5 μm.

The resin solution and the pigment dispersion were mixed at a mixing ratio (mass ratio) of 3:1 to obtain cyan liquid developer. The cyan liquid developer contains 5 mass % of colored particles (cyan pigment) and 1 mass % of polymer compounds (styrene elastomer).

(Yellow Liquid Developer)

Styrene-butadiene elastomer (1.33 mass parts: "Asaprene (registered trademark) T-413" produced by Asahi Kasei Chemicals Corporation: styrene content of 30 mass %) was prepared as polymer compounds. Vegetable oil (98.67 mass parts: medium-chain triglyceride "Coconard MT" produced by Kao Corporation) was prepared as solvent for dissolving the polymer compounds. The polymer compounds were dissolved in the vegetable oil to prepare resin solution.

Liquid paraffin (72 mass parts: "MORESCO WHITE P-200" produced by Matsumura Oil Co., Ltd.) was prepared as carrier liquid. "Antaron (registered trademark) V-216" (8 mass parts) produced by ISP Chemicals was prepared as dispersion stabilizer. Yellow pigment (20 mass parts: Pigment yellow 74) was prepared as the colored particles. The carrier liquid, the dispersion stabilizer and the polymer compounds were mixed and dispersed for 1 hour by means of a rocking mill (RM-10 produced by Seiwa Giken Co, Ltd.) to obtain pigment dispersion. It should be noted that a drive frequency of the rocking mill was 60 Hz. An average particle diameter (D50) of the pigment in the pigment dispersion was 0.5 μm.

The resin solution and the pigment dispersion were mixed at a mixing ratio (mass ratio) of 3:1 to obtain yellow liquid developer. The yellow liquid developer contains 5 mass % of colored particles (yellow pigment) and 1 mass % of polymer compounds (styrene elastomer).

(Magenta Liquid Developer)

Styrene-butadiene elastomer (1.33 mass parts: "Asaprene (registered trademark) T-413" produced by Asahi Kasei Chemicals Corporation: styrene content of 30 mass %) was prepared as polymer compounds. Vegetable oil (98.67 mass parts: medium-chain triglyceride "Coconard MT" produced by Kao Corporation) was prepared as solvent for dissolving the polymer compounds. The polymer compounds were dissolved in the vegetable oil to prepare resin solution.

Liquid paraffin (72 mass parts: "MORESCO WHITE P-200" produced by Matsumura Oil Co., Ltd.) was prepared as carrier liquid. "Antaron (registered trademark) V-216" (8 mass parts) produced by ISP Chemicals was prepared as dispersion stabilizer. Magenta pigment (20 mass parts: PIGMENT Red 57:1) were prepared as the colored particles. The carrier liquid, the dispersion stabilizer and the polymer compounds were mixed and dispersed for 1 hour by means of a rocking mill (RM-10 produced by Seiwa Giken Co, Ltd.) to obtain pigment dispersion. It should be noted that a drive frequency of the rocking mill was 60 Hz. An average particle diameter (D50) of the pigment in the pigment dispersion was 0.5 μm.

The resin solution and the pigment dispersion were mixed at a mixing ratio (mass ratio) of 3:1 to obtain magenta liquid developer. The magenta liquid developer contains 5 mass % of colored particles (magenta pigment) and 1 mass % of polymer compounds (styrene elastomer).

(Test Sample (Single Color))

Figure 7A:
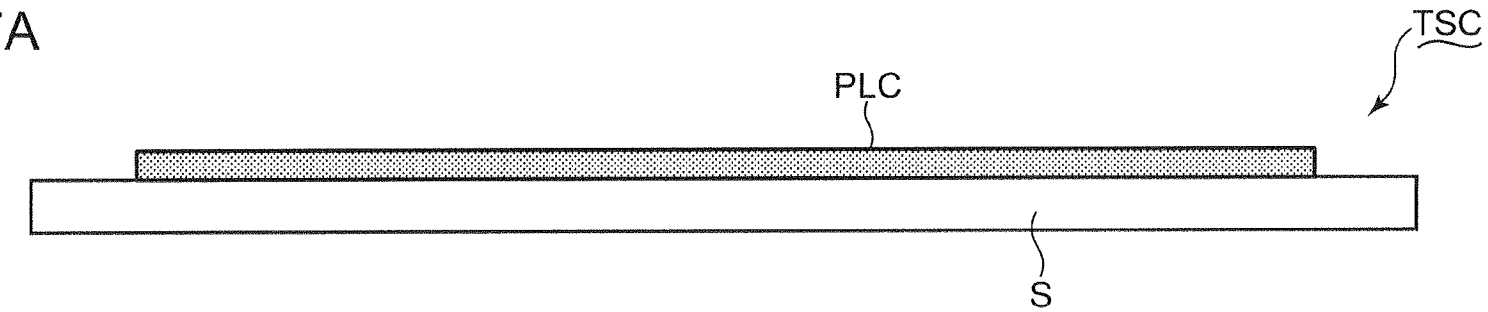
FIG. 7A is a schematic view of a test sample including a print pattern formed by means of cyan liquid developer.
Figure 7B:
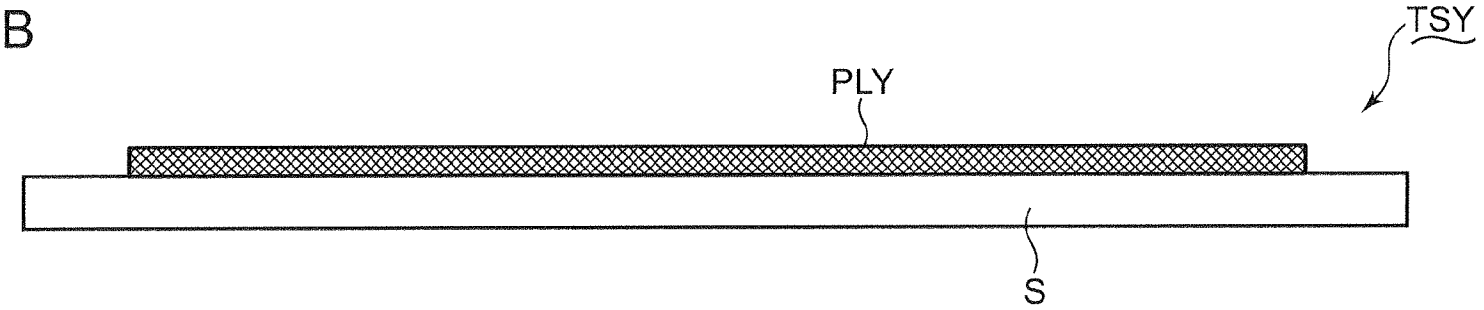
FIG. 7B is a schematic view of a test sample including a print pattern formed by means of yellow liquid developer.
Figure 7C:
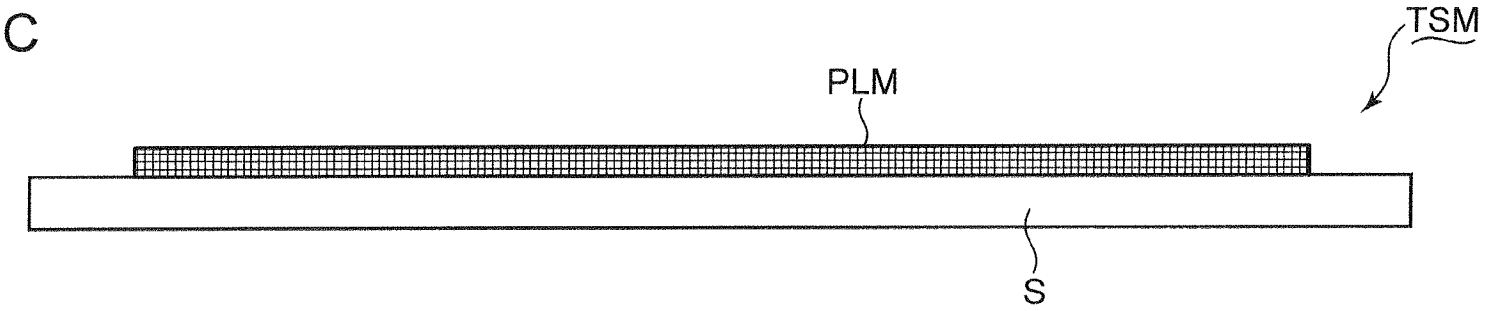
FIG. 7C is a schematic view of a test sample including a print pattern formed by means of magenta liquid developer.

FIG. 7A is a schematic view showing a test sample TSC including a print pattern formed by means of the aforementioned cyan liquid developer. FIG. 7B is a schematic view showing a test sample TSY including a print pattern formed by means of the aforementioned yellow liquid developer. FIG. 7C is a schematic view showing a test sample TSM including a print pattern formed by means of the aforementioned magenta liquid developer.

The test sample TSC includes a sheet S and a pattern layer PLC formed on the sheet S by means of the aforementioned cyan liquid developer. The test sample TSY includes a sheet S and a pattern layer PLY formed on the sheet S by means of the aforementioned yellow liquid developer. The test sample TSM includes a sheet S and a pattern layer PLM formed on the sheet S by means of the aforementioned magenta liquid developer.

The cyan liquid developer was supplied to a surface of a photoconductive drum having a surface potential of 450 V under application of a development bias of 300 V to form a cyan image on the surface of the photoconductive drum. A linear speed of the photoconductive drum (tangential speed of the circumferential surface of the photoconductive drum) was 0.1 m/sec. Thereafter, the cyan image was transferred to the sheet S via a transfer belt to form the pattern layer PLC.

The yellow liquid developer was supplied to a surface of a photoconductive drum having a surface potential of 450 V under application of a development bias of 300 V to form a yellow image on the surface of the photoconductive drum. A linear speed of the photoconductive drum (tangential speed of the circumferential surface of the photoconductive drum) was 0.1 m/sec. Thereafter, the yellow image was transferred to the sheet S via the transfer belt to form the pattern layer PLY.

The magenta liquid developer was supplied to a surface of a photoconductive drum having a surface potential of 450 V under application of a development bias of 300 V to form a magenta image on the surface of the photoconductive drum. A linear speed of the photoconductive drum (tangential speed of the circumferential surface of the photoconductive drum) was 0.1 m/sec. Thereafter, the magenta image was transferred to the sheet S via the transfer belt to form the pattern layer PLM.

The image forming apparatus used to produce the aforementioned test samples TSC, TSY, TSM is described later. The image forming apparatus includes a fixing device for fixing the pattern layers PLC, PLY, PLM on the sheet S. The fixing device rubs the pattern layers PLC, PLY, PLM in accordance with the aforementioned fixing principles. The test samples TSC, TSY, TSM shown in FIGS. 7A to 7C were used in the following rubbing test after fixing processes by the fixing device.

(Rubbing Test (Single Color))

Figure 8:
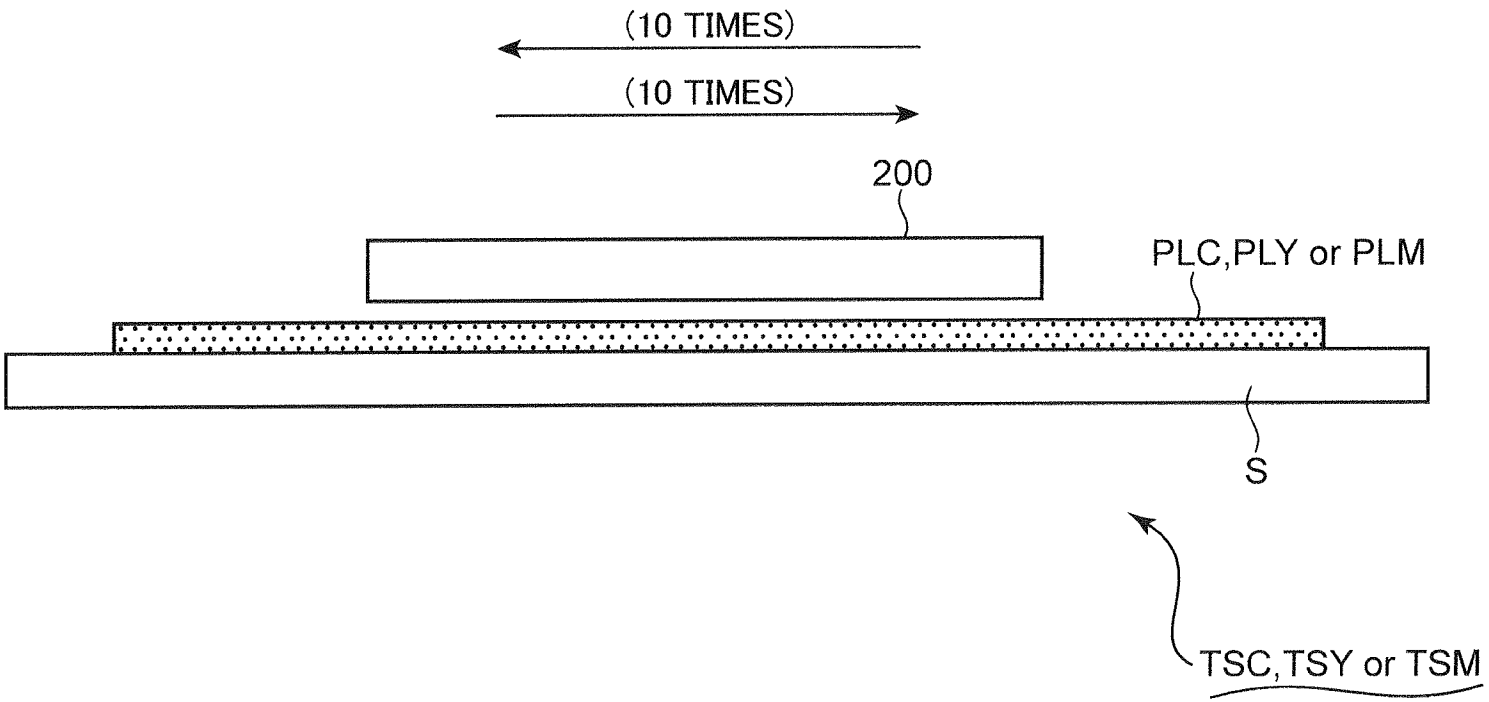
FIG. 8 is a schematic view showing a rubbing test conducted on the test samples depicted in FIGS. 7A to 7C, FIGS. 9A to 9D are schematic flow charts respectively for producing test samples formed by means of the cyan, yellow and magenta liquid developers.

FIG. 8 is a schematic side view showing the test sample TSC, TSY or TSM subjected to the rubbing test. The rubbing test is described with reference to FIG. 8.

The rubbing plate 200 was pressed against each pattern layer PLC, PLY, PLM with a force of 1 kgf. Thereafter, the rubbing plate 200 was slid to rub each pattern layer PLC, PLY, PLM 20 times (rightward: 10 times, leftward: 10 times) with keeping the pressure to each pattern layer PLC, PLY, PLM.

Optical density of each pattern layer PLC, PLY, PLM was measured before and after the rubbing by the rubbing plate 200. The optical density was measured by means of a reflection densitometer "Spectroeye" produced by Macbeth.

(Evaluation of Fixing Property (Single Color))

The following equation was used to quantitatively evaluate the fixing properties of the liquid developer.

$$\text{Residual Ratio} = \frac{\text{Optical Density after Rubbing}}{\text{Optical Density before Rubbing}} \times 100\% \quad \text{[Equation 2]}$$

It means that the closer to "100%" the residual ratio expressed by the aforementioned Equation, the higher fixing properties the liquid developer has. Specifically, it means that the lower a change rate of the optical density before and after the rubbing, the higher fixing properties the liquid developer has. It should be noted that the change rate of the optical density may be quantitatively expressed by the following Equation.

$$\text{Change Rate of Optical Density} = \frac{\text{Optical Density before Rubbing} - \text{Optical Density after Rubbing}}{\text{Optical Density before Rubbing}} \times 100\% \quad \text{[Equation 3]}$$

The result of the rubbing test is shown in the following Table.

TABLE 1

| | Residual Ratio | Change Rate |
|---|---|---|
| Test Sample TSC | 95% | 5% |
| Test Sample TSY | 100% | 0% |
| Test Sample TSM | 94% | 6% |

Since the test sample TSY shows the highest residual ratio (i.e. the lowest change rate) in the aforementioned test result, the yellow liquid developer has the highest fixing properties. Since the test sample TSM shows the lowest residual ratio (i.e. highest change rate), the magenta liquid developer has the lowest fixing properties. Since the test sample TSC has a residual ratio higher than the test sample TSM and lower than the test sample TSY (i.e. has a change rate higher than the test sample TSY and lower than the test sample TSM), the cyan liquid developer has fixing properties higher than the magenta liquid developer and lower than the yellow liquid developer.

It may be understood from the aforementioned test result that the fixing properties of the liquid developers differ due to differences of pigment components in the liquid developer. If other components of the liquid developer differ, the fixing properties of the liquid developer similarly changes. In this embodiment, the yellow liquid developer having the highest fixing properties is exemplified as the first liquid developer. The pattern layer PLY formed by means of the yellow liquid developer is exemplified as the first image. The cyan liquid developer having the second highest fixing properties next to the yellow liquid developer is exemplified as the second liquid developer. The pattern layer PLC formed by means of the cyan liquid developer is exemplified as the second image. The magenta liquid developer having the lowest fixing properties is exemplified as the third liquid developer. The pattern layer PLM formed by means of the magenta liquid developer is exemplified as the third image.

(Test Sample (Plural Colors))

FIGS. 9A to 9D are schematic flow charts for producing test samples TS1 to TS4 by means of the cyan, yellow and magenta liquid developers. FIG. 10A is a schematic side view of the test sample TS1 produced in accordance with the flow chart shown in FIG. 9A. FIG. 10B is a schematic side view of the test sample TS2 produced in accordance with the flow chart shown in FIG. 9B. FIG. 10C is a schematic side view of the test sample TS3 produced in accordance with the flow chart shown in FIG. 9C. FIG. 10D is a schematic side view of the test sample TS4 produced in accordance with the flow chart shown in FIG. 9D. The test samples TS1 to TS4 formed by means of the liquid developers of a plurality of colors are described with reference to FIGS. 9A to 10D.

Figure 9A:
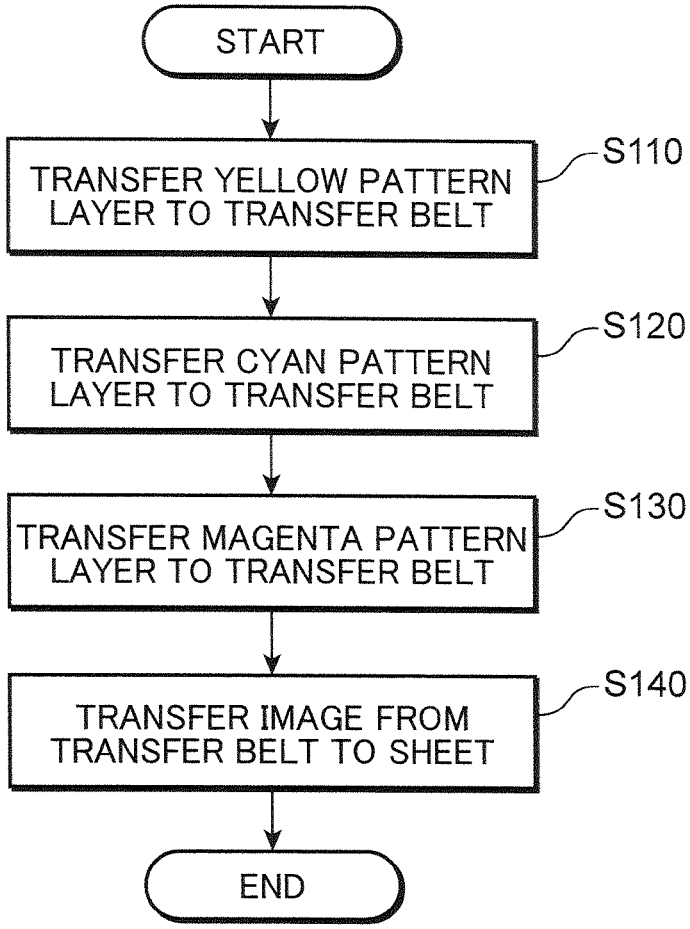
Figure 10A:
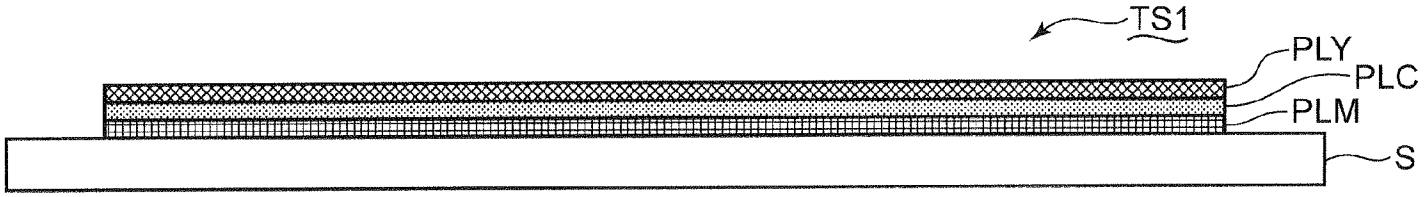
FIG. 10A is a schematic side view showing the test sample produced in accordance with the flow chart depicted in FIG. 9A.
Figure 10B:
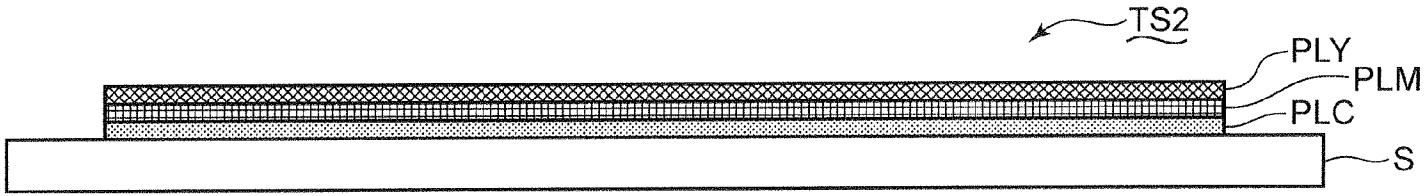
FIG. 10B is a schematic side view showing the test sample produced in accordance with the flow chart depicted in FIG. 9B.
Figure 10C:
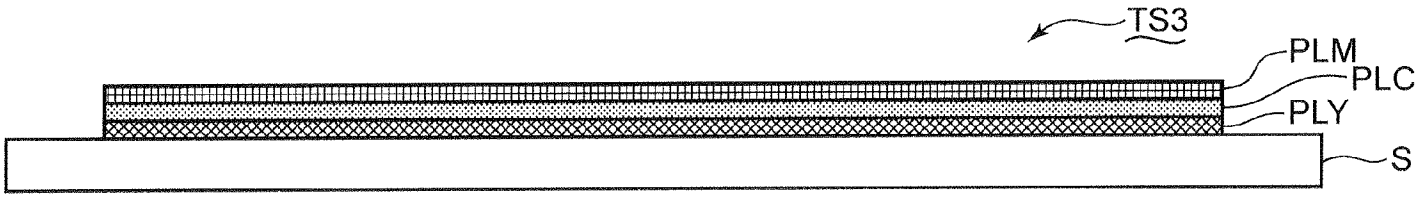
FIG. 10C is a schematic side view showing the test sample produced in accordance with the flow chart depicted in FIG. 9C.
Figure 10D:
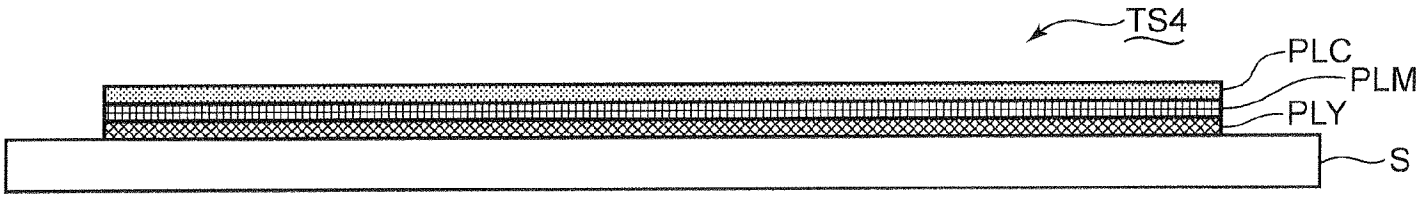
FIG. 10D is a schematic side view showing the test sample produced in accordance with the flow chart depicted in FIG. 9D.

FIG. 9A is the schematic flow chart showing a procedure of producing the test sample TS1. It should be noted that the image forming apparatus for forming an image in accordance with the flow chart of FIG. 9A is described later.

(Step S110)

In Step S110, the yellow pattern layer PLY is transferred onto the transfer belt. Thereafter, Step S120 is performed.

(Step S120)

In Step S120, the cyan pattern layer PLC is transferred onto the transfer belt. The cyan pattern layer PLC is superimposed on the yellow pattern layer PLY on the transfer belt. Thereafter, Step S130 is performed.

(Step S130)

In Step S130, the magenta pattern layer PLM is transferred onto the transfer belt. The magenta pattern layer PLM is superimposed on the yellow and cyan pattern layers PLY, PLC on the transfer belt. Thereafter, Step S140 is performed.

(Step S140)

In Step S140, an image (pattern layers PLY, PLC, PLM) is transferred onto the sheet S. Consequently, the pattern layer PLM is superimposed on the sheet S as shown in FIG. 10A. The pattern layer PLY appears on the outermost side. The pattern layer PLC is situated between the pattern layers PLY, PLM.

Figure 9B:
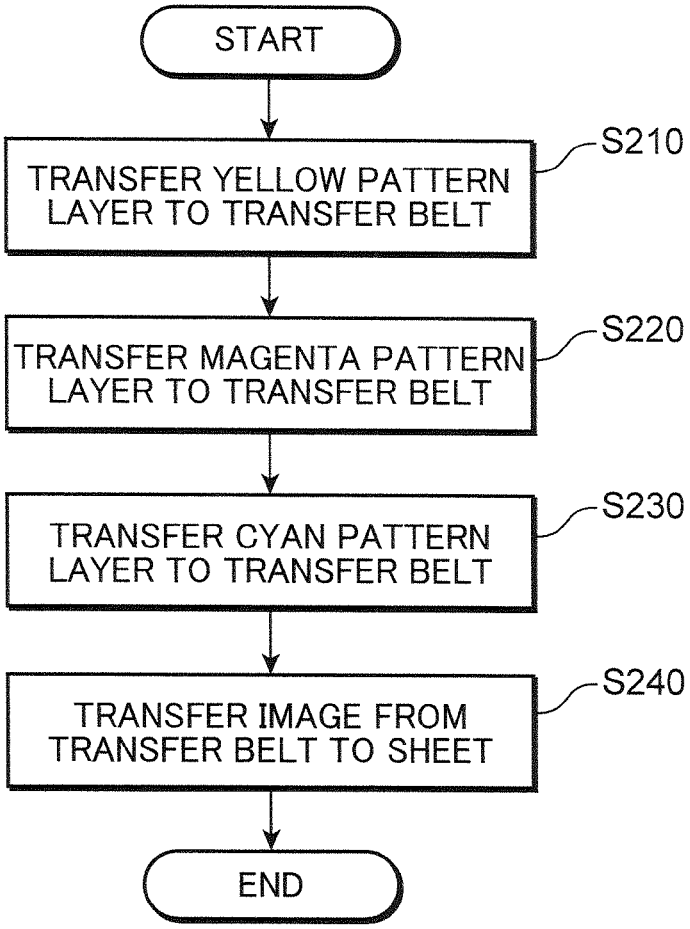

FIG. 9B is the schematic flow chart showing a procedure of producing the test sample TS2. FIG. 10B is the schematic side view showing the test sample TS2. The test sample TS2 is described with reference to FIGS. 9B and 10B.

(Step S210)

In Step S210, the yellow pattern layer PLY is transferred onto the transfer belt. Thereafter, Step S220 is performed.

(Step S220)

In Step S220, the magenta pattern layer PLM is transferred onto the transfer belt. The magenta pattern layer PLM is superimposed on the yellow pattern layer PLY on the transfer belt. Thereafter, Step S230 is performed.

(Step S230)

In Step S230, the cyan pattern layer PLC is transferred onto the transfer belt. The cyan pattern layer PLC is superimposed on the yellow and magenta pattern layers PLY, PLM on the transfer belt. Thereafter, Step S240 is performed.

(Step S240)

In Step S240, an image (pattern layers PLY, PLC, PLM) is transferred onto the sheet S. Consequently, the pattern layer PLC is superimposed on the sheet S as shown in FIG. 10B. The pattern layer PLY appears on the outermost side. The pattern layer PLM is situated between the pattern layers PLY, PLC.

Figure 9C:
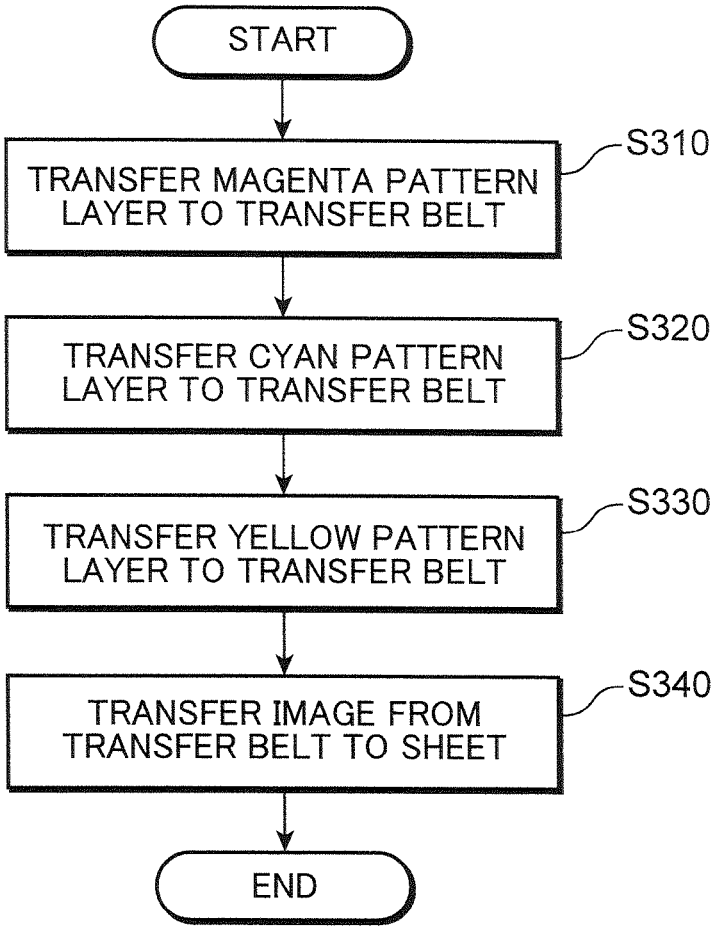

FIG. 9C is the schematic flow chart showing a procedure of producing the test sample TS3. FIG. 10C is the schematic side view showing the test sample TS3. The test sample TS3 is described with reference to FIGS. 9C and 10C.

(Step S310)

In Step S310, the magenta pattern layer PLM is transferred onto the transfer belt. Thereafter, Step S320 is performed.

(Step S320)

In Step S320, the cyan pattern layer PLC is transferred onto the transfer belt. The cyan pattern layer PLC is superimposed on the magenta pattern layer PLM on the transfer belt. Thereafter, Step S330 is performed.

(Step S330)

In Step S330, the yellow pattern layer PLY is transferred onto the transfer belt. The yellow pattern layer PLY is superimposed on the cyan and magenta pattern layers PLC, PLM on the transfer belt. Thereafter, Step S340 is performed.

(Step S340)

In Step S340, an image (pattern layers PLY, PLC, PLM) is transferred onto the sheet S. Consequently, the pattern layer PLY is superimposed on the sheet S as shown in FIG. 10C. The pattern layer PLM appears on the outermost side. The pattern layer PLC is situated between the pattern layers PLY, PLM.

Figure 9D:
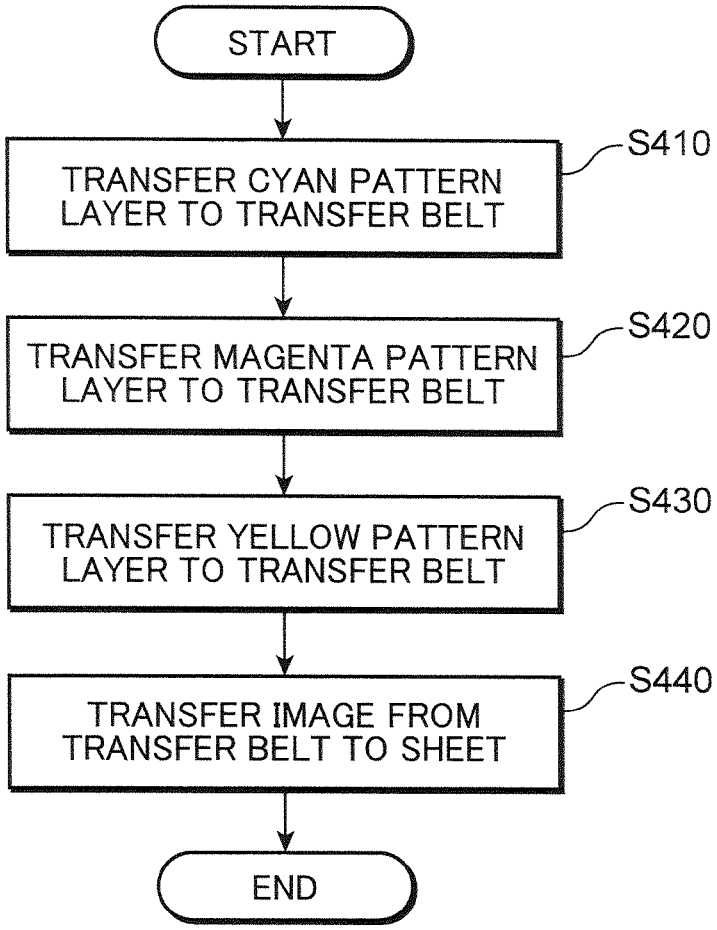

FIG. 9D is the schematic flow chart showing a procedure of producing the test sample TS4. FIG. 10D is the schematic side view showing the test sample TS4. The test sample TS4 is described with reference to FIGS. 9D and 10D.

(Step S410)

In Step S410, the cyan pattern layer PLC is transferred onto the transfer belt. Thereafter, Step S420 is performed.

(Step S420)

In Step S420, the magenta pattern layer PLM is transferred onto the transfer belt. The magenta pattern layer PLM is superimposed on the cyan pattern layer PLC on the transfer belt. Thereafter, Step S430 is performed.

(Step S430)

In Step S430, the yellow pattern layer PLY is transferred onto the transfer belt. The yellow pattern layer PLY is superimposed on the cyan and magenta pattern layers PLC, PLM on the transfer belt. Thereafter, Step S440 is performed.

(Step S440)

In Step S440, an image (pattern layers PLY, PLC, PLM) is transferred onto the sheet S. Consequently, the pattern layer PLY is superimposed on the sheet S as shown in FIG. 10D. The pattern layer PLC appears on the outermost side. The pattern layer PLM is situated between the pattern layers PLY, PLC.

The following table shows a result from the rubbing test for Test Samples TS1-TS4 depicted in FIGS. 10A to 10D.

TABLE 2

| | Residual Ratio | Change Rate |
|---|---|---|
| Test Sample TS1 | 90% | 10% |
| Test Sample TS2 | 85% | 15% |
| Test Sample TS3 | 72% | 28% |
| Test Sample TS4 | 69% | 31% |

It may be understood from the aforementioned result that the change rate of the optical density of the image is the lowest if the pattern layer PLY formed by means of the yellow liquid developer having the highest fixing properties is situated on the outermost side. Preferably, the pattern layers are superimposed on the sheet S in an increasing order of the fixing properties.

If the pattern layers are superimposed by means of a several types of liquid developer, a liquid developer layer on the sheet S becomes thicker. As a result, it takes longer for the carrier liquid to permeate and form an image on the sheet S by means of several types of liquid developer than single liquid developer. Thus, the change rate of the optical density becomes larger in the multi-color test samples than the single-color samples.

If one type of liquid developer, which has relatively high fixing properties, is transferred to the transfer belt before other types of liquid developer, a layer of the liquid developer with relatively low fixing properties is situated between the sheet and the layer of the liquid developer with relatively high fixing properties. A permeation rate of the carrier liquid of the liquid developer having high fixing properties is likely to be relatively high. Accordingly, polymer compounds of the liquid developer having relatively high fixing properties deposit relatively early. As described above, if the layer of the liquid developer having relatively high fixing properties is situated on the outer side of the layer of the other liquid developer, the polymer compounds deposited earlier are less likely to interfere with permeation of the carrier liquid of the other liquid developer. Thus, the permeation rate of the carrier liquid of the pattern layers PLY, PLC, PLM of the test sample TS1 becomes relatively high. Accordingly, relatively high fixing properties (i.e. high residual rate (low change rate)) may be achieved in the test sample TS1.

<Image Forming Apparatus>

Figure 11:
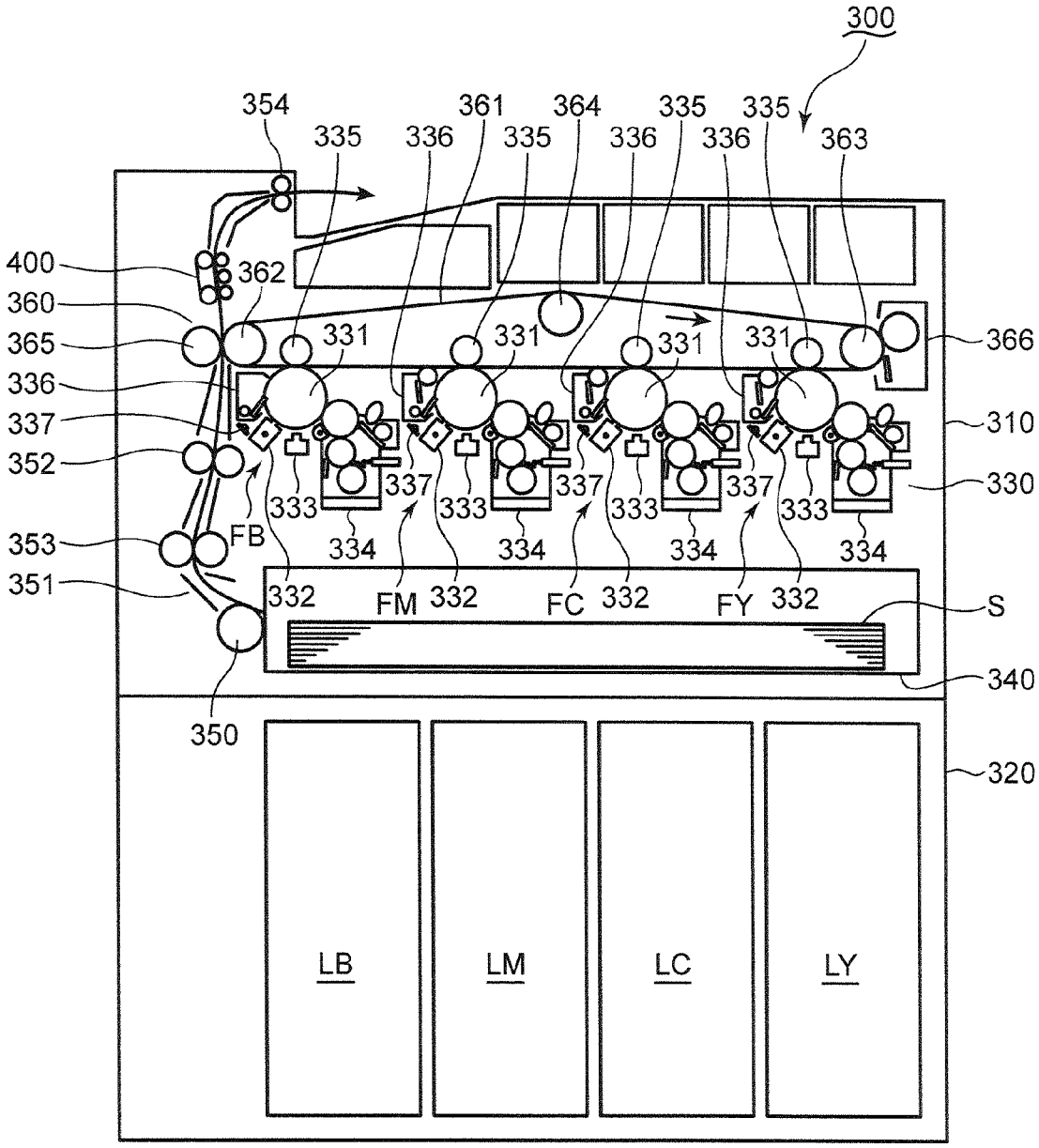
FIG. 11 is a schematic view of an image forming apparatus used to produce a test sample which achieves the lowest change rate of optical density.

FIG. 11 is a schematic view of the image forming apparatus used to produce the test sample TS1 which achieves the lowest change rate of the optical density. In this embodiment, a color printer 300 is exemplified as the image forming apparatus. The color printer 300 is described with reference to FIG. 11. It should be noted that the image forming apparatus may be a copier, a facsimile machine, a complex machine including these functions or another apparatus configured to form an image on a sheet S.

The color printer 300 includes an upper housing 310, in which various devices and parts for forming images are stored, and a lower housing 320 situated below the upper housing 310. The color printer 300 further includes circulation devices LY, LC, LM, LB for circulating the liquid developer. The circulation devices LY, LC, LM, LB are stored in the lower housing 320. It should be noted that the circulation device LY circulates the aforementioned yellow liquid developer. The circulation device LC circulates the above cyan liquid developer. The circulation device LM circulates the aforementioned magenta liquid developer. The circulation device LB circulates black liquid developer for drawing a black component image in an image.

The color printer 300 includes an image forming station 330 configured to form an image by means of the liquid developers. The image forming station 330 includes an image forming unit FY, which forms an image by means of the yellow liquid developer, an image forming unit FC, which forms an image by means of the cyan liquid developer, an image forming unit FM, which forms an image by means of the magenta liquid developer, and an image forming unit FB, which forms an image by means of the black liquid developer. The image forming units FY, FC, FM, FB are situated in the upper housing 310. The yellow liquid developer is circulated between the circulation device LY and the image forming unit FY. The cyan liquid developer is circulated between the circulation device LC and the image forming unit FC. The magenta liquid developer is circulated between the circulation device LM and the image forming unit FM. The black liquid developer is circulated between the circulation device LB and the image forming unit FB. Liquid developer circulation technologies used in known image forming apparatuses may be appropriately used for the circulation principle of the liquid developers by the circulation devices LY, LC, LM, LB. Thus, pipes connecting the circulation devices LY, LC, LM, LB to the image forming units FY, FC, FM, FB are not shown in FIG. 11. In this embodiment, the image forming station 330 is exemplified as the image forming mechanism. The image forming unit FY is exemplified as the first image forming mechanism. The image forming unit FC is exemplified as the second image forming mechanism. The image forming unit FM is exemplified as the third image forming mechanism.

Figure 12:
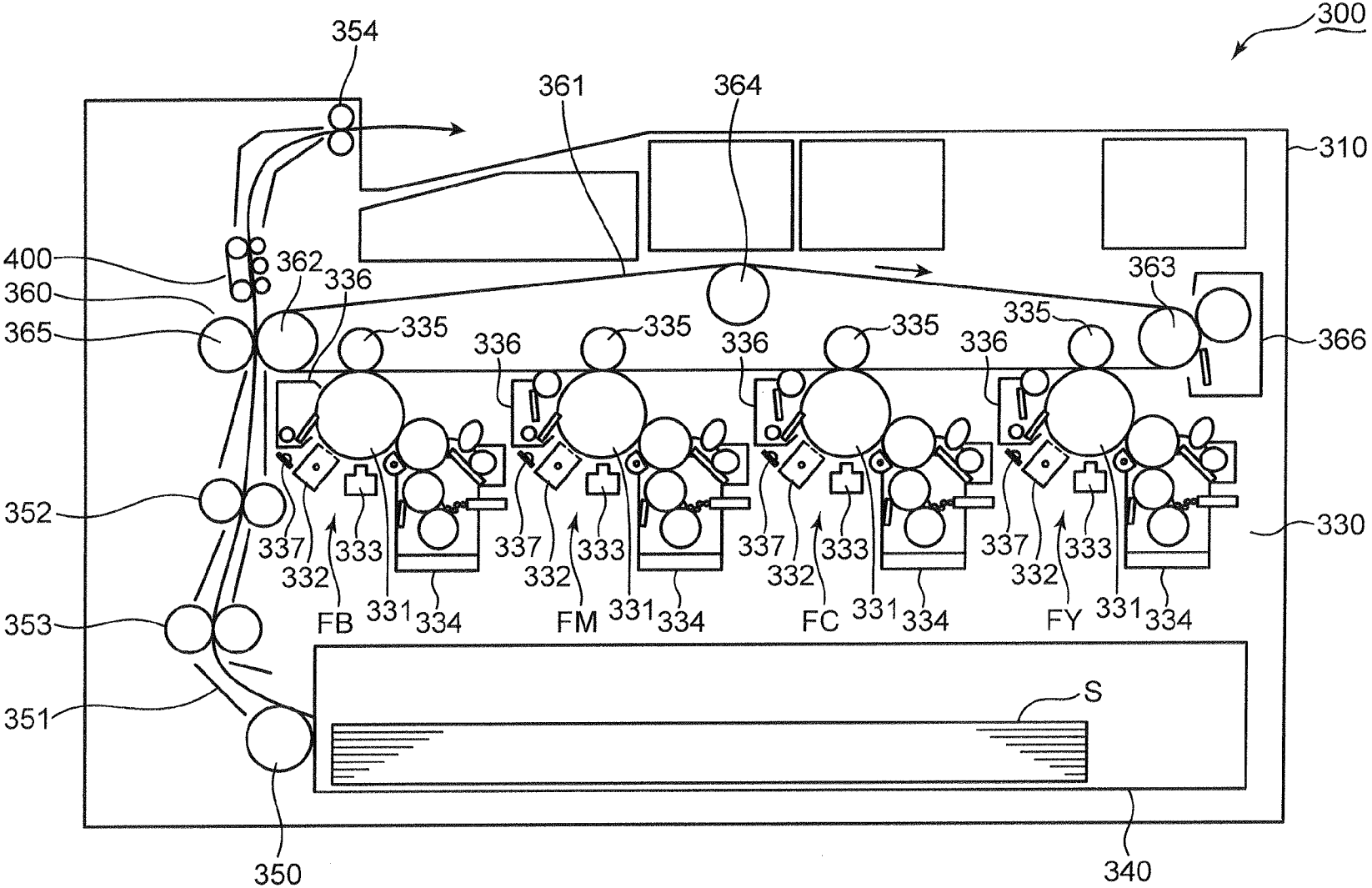
FIG. 12 is a schematic view showing an internal structure of an upper housing of the image forming apparatus depicted in FIG. 11, FIGS. 13A to 13D are schematic views respectively showing transfer of an image to a transfer belt of the image forming apparatus depicted in FIG. 11.
Figure 13A:
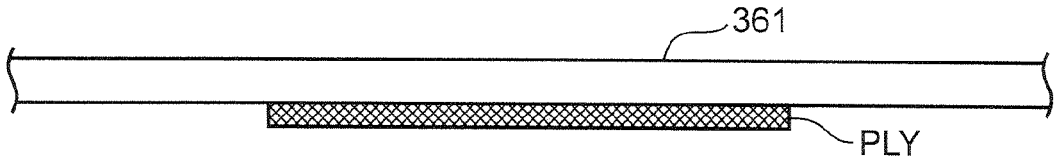
Figure 13B:
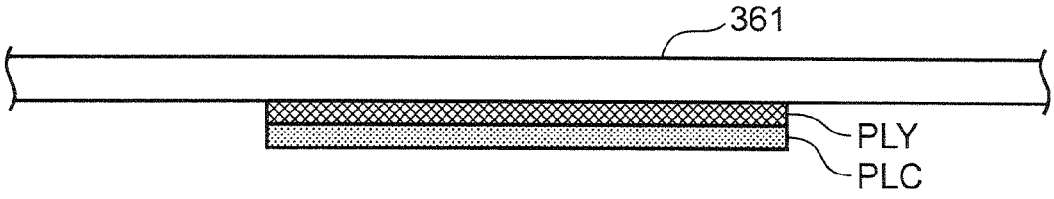
Figure 13C:
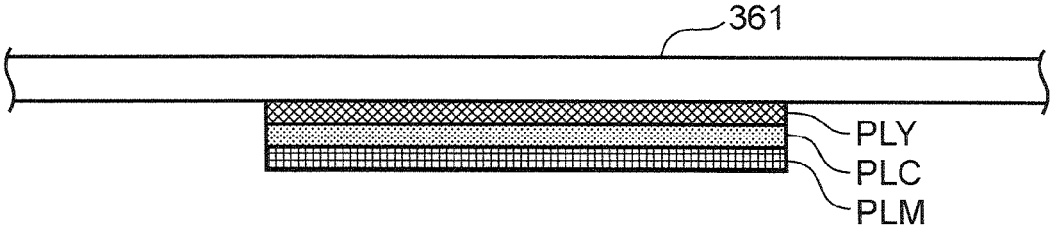
Figure 13D:
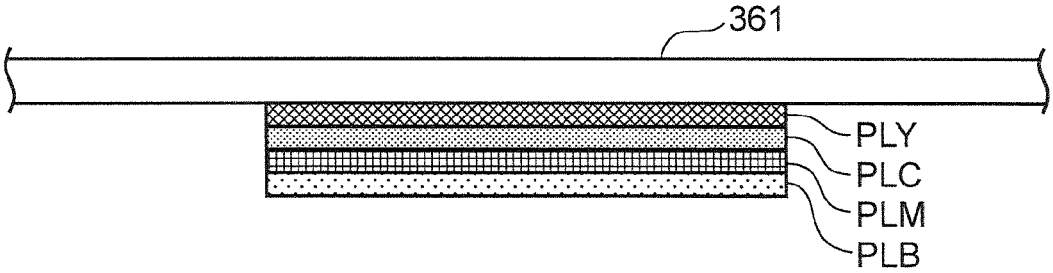

FIG. 12 is a schematic view showing an internal structure of the upper housing 310. The color printer 300 is further described with reference to FIGS. 3, 11 and 12.

The color printer 300 further includes a cassette 340, which stores sheets S, and a sheet feeding mechanism 350, which picks up the sheets S from the cassette 340. A sheet feeding structure of a general apparatus such as a printer or a copier may be applied to the sheet feeding mechanism 350 for picking up the sheets S from the cassette 340.

The color printer 300 further includes a transfer mechanism 360 configured to transfer an image formed by the image forming units FY, FC, FM, FB to a sheet S. The upper housing 310 defines a sheet conveyance path 351 extending upward from the sheet feeding mechanism 350 to the transfer mechanism 360. The sheet S is guided by the sheet conveyance path 351 and conveyed toward the transfer mechanism 360.

The color printer 300 further includes a registration roller pair 352, which feeds the sheet S to the transfer mechanism 360 in synchronization with an image transfer timing to the sheet S by the transfer mechanism 360, and a conveyor roller pair 353, which feeds the sheet S fed from the sheet feeding mechanism 350 to the registration roller pair 352. The sheet S picked up from the cassette 340 by the sheet feeding mechanism 350 is conveyed upward by the conveyor roller pair 353. Thereafter, the registration roller pair 352 adjusts a conveyance timing of the sheet S and feeds the sheet S to the transfer mechanism 360. The transfer mechanism 360 transfers an image formed by the image forming units FY, FC, FM, FB to the sheet S.

The color printer 300 further includes a fixing device 400, which fixes the image transferred by the transfer mechanism 360 to the sheet S, and a discharge mechanism 354 which discharges the sheet S from the upper housing 310. The fixing device 400 rubs the image on the sheet S. The discharge mechanism 354 then discharges the sheet S from the upper housing 310. In this embodiment, the fixing device 400 is exemplified as the rubbing mechanism.

The transfer mechanism 360 transfers the image to the sheet S while the sheet S is conveyed from the registration roller pair 352 to the fixing device 400. The transfer mechanism 360 includes a transfer belt 361, to which images are sequentially transferred by the image forming units FY, FC, FM, FB, a drive roller 362, which drives the transfer belt 361, an idler 363 which defines a travel path of the transfer belt 361 together with the drive roller 362, a tension roller 364, which stabilizes the travel of the transfer belt 361 by applying tension to the transfer belt 361, a transfer roller 365, which is pressed against the transfer belt 361 wound around the drive roller 362, and a cleaning device 366, which cleans the transfer belt 361. The registration roller pair 352 feeds the sheet S to a nip between the transfer roller 365 and the transfer belt 361 wound around the drive roller 362.

The image forming units FY, FC, FM, FB are arranged along the lower surface of the transfer belt 361. The image forming unit FY transfers an image formed with the yellow liquid developer to the outer surface of the transfer belt 361. Thereafter, the transfer belt 361 moves to an image transfer position by the image forming unit FC with carrying the image formed with the yellow liquid developer. The image forming unit FC transfers an image formed with the cyan liquid developer to the outer surface of the transfer belt 361. Accordingly, the image formed with the cyan liquid developer is superimposed on the image formed with the yellow liquid developer. Thereafter, the transfer belt 361 moves to an image transfer position by the image forming unit FM with carrying the images formed with the yellow and cyan liquid developers. The image forming unit FM transfers an image formed with the magenta liquid developer to the outer surface of the transfer belt 361. Accordingly, the image formed with the magenta liquid developer is superimposed on the images formed with the yellow and cyan liquid developers. The transfer belt 361 moves to an image transfer position by the image forming unit FB with carrying the images formed with the yellow, cyan and magenta liquid developers. The image forming unit FB transfers an image formed with the black liquid developer to the outer surface of the transfer belt 361. Accordingly, the yellow, cyan, magenta and black images transferred from the image forming units FY, FC, FM, FB to the transfer belt 361 are superimposed on the transfer belt 361 to form a full-color image. The full-color image on the transfer belt 361 is transferred to the sheet S which is fed to the nip between the transfer roller 365 and the transfer belt 361 wound around the drive roller 362. In this embodiment, the outer surface of the transfer belt 361 is exemplified as the carrying surface.

Each of the image forming units FY, FC, FM, FB includes a photoconductive drum 331, a charger 332, which substantially uniformly charges the circumferential surface of the photoconductive drum 331, and an exposure device 333, which irradiates the charged circumferential surface of the photoconductive drum 331 with laser light. The photoconductive drum 331 rotates so that a linear speed (tangential speed on the circumferential surface) becomes "0.1 m/sec". The charger 332 produces a surface potential of 400 V on the circumferential surface of the photoconductive drum 331 as described above. The photoconductive drum 331 charged by the charger 332 rotates and moves to a laser light irradiation position by the exposure device 333. The exposure device 333 irradiates the circumferential surface of the photoconductive drum 331 with laser light in response to image data transmitted from an external apparatus (not shown: e.g. personal computer). As a result, an electrostatic latent image corresponding to the image data is formed on the circumferential surface of the photoconductive drum 331.

Each of the image forming units FY, FC, FM, FB further includes a developing device 334 configured to apply the liquid developer to the circumferential surface of the photoconductive drum 331. As a result of the rotation of the photoconductive drum 331, the circumferential surface of the photoconductive drum 331, on which the electrostatic latent image is formed, moves to a liquid developer application position by the developing device 334. The developing device 334 applies the liquid developer to the photoconductive drum 331 under a development bias condition of 300 V. Consequently, the electrostatic latent image on the circumferential surface of the photoconductive drum 331 is developed. The developing device 334 may be a known developing device for developing an electrostatic latent image using liquid developer. It should be noted that the yellow liquid developer is circulated between the developing device 334 of the image forming unit FY and the circulation device LY. The cyan liquid developer is circulated between the developing device 334 of the image forming unit FC and the circulation device LC. The magenta liquid developer is circulated between the developing device 334 of the image forming unit FM and the circulation device LM. The black liquid developer is circulated between the developing device 334 of the image forming unit FB and the circulation device LB.

Each of the image forming units FY, FC, FM, FB further includes a transfer roller 335 which transfers an image developed on the photoconductive drum 331 to the transfer belt 361. The transfer belt 361 passes between the transfer roller 335 and the photoconductive drum 331. The transfer roller 335 presses the transfer belt 361 against the circumferential surface of the photoconductive drum 331. A voltage having a polarity (negative in this embodiment) opposite to that of the colored particles P on the photoconductive drum 331 is applied to the transfer roller 335 from a power supply (not shown). The transfer roller 355 applies a voltage having a polarity opposite to that of toner to the transfer belt 361. As a result, the colored particles and the polymer compounds are attracted to the surface of the conductive transfer belt 361. Thus, the image formed on the photoconductive drum 331 is transferred to the surface of the transfer belt 361. Thereafter, the transfer belt 361 carries and conveys the image to the sheet S.

Each of the image forming units FY, FC, FM, FB further includes a cleaning device 336 configured to remove the liquid developer from the photoconductive drum 331. The circumferential surface of the photoconductive drum 331 rotates and moves to the cleaning device 336 after the image transfer to the transfer belt 361. The cleaning device 336 removes the liquid developer remaining on the circumferential surface of the photoconductive drum 331.

Each of the image forming units FY, FC, FM, FB further includes a neutralizer 337 configured to electrically neutralize the circumferential surface of the photoconductive drum 331. The circumferential surface of the photoconductive drum 331 cleaned by the cleaning device 336 rotates and moves to a neutralization position by the neutralizer 337. The neutralizer 337 removes electric charges from the circumferential surface of the photoconductive drum 331. Then, the circumferential surface of the photoconductive drum 331 is charged by the charger 332 again. Thereafter, the aforementioned image forming process is performed again to transfer a new image to the transfer belt 361.

As a result of the image transfer by the image forming units FY, FC, FM, FB, the full-color image is carried toward the transfer roller 365 by the transfer belt 361. Since the sheet S is fed to the nip between the transfer roller 365 and the transfer belt 361 wound around the drive roller 362 at an appropriate timing by the registration roller pair 352, the image is transferred in position on the sheet S. Thereafter, the surface of the transfer belt 361 after the image transfer to the sheet S moves toward the cleaning device 366. The cleaning device 366 removes the liquid developer remaining on the transfer belt 361. The surface of the transfer belt 361 cleaned by the cleaning device 366 then passes between the transfer roller 335 and the photoconductive drum 331 and is subjected to transfer of a new image.

<Transfer Process>

Figure 14:
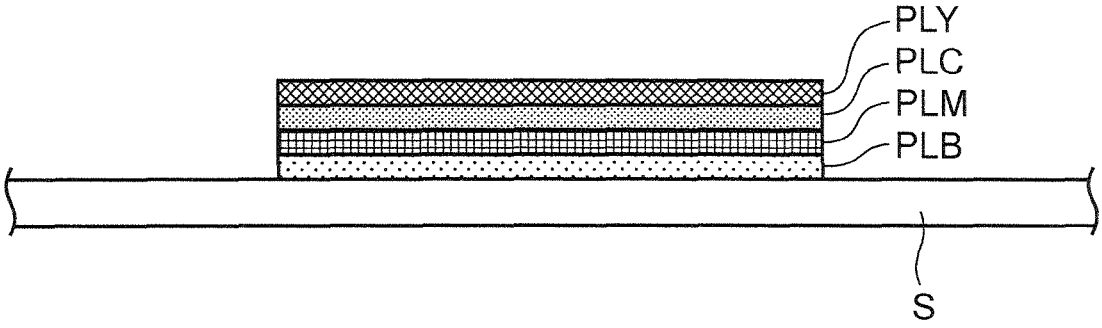
FIG. 14 is a schematic view of a sheet with an image formed by the image forming apparatus shown in FIG. 11.

FIGS. 13A to 13D are schematic views showing the transfer of an image to the transfer belt 361. FIG. 14 is a schematic view of a sheet S carrying an image formed by the color printer 300. A transfer process is described with reference to FIGS. 12 to 14.

As described above, the image forming unit FY transfers an image formed with the yellow liquid developer to the transfer belt 361 at first. As a result, the transfer belt 361 carries the pattern layer PLY formed with the yellow liquid developer (c.f., FIG. 13A). Thereafter, the transfer belt 361 moves to the image transfer position by the image forming unit FC.

The image forming unit FC transfers an image formed with the cyan liquid developer to the transfer belt 361. As a result, the transfer belt 361 carries the pattern layer PLC formed with the cyan liquid developer in addition to the pattern layer PLY (c.f., FIG. 13B). Meanwhile, the pattern layer PLC is superimposed on the pattern layer PLY. Thereafter, the transfer belt 361 moves to the image transfer position by the image forming unit FM.

The image forming unit FM transfers an image formed with the magenta liquid developer to the transfer belt 361. As a result, the transfer belt 361 carries the pattern layer PLM formed with the magenta liquid developer in addition to the pattern layers PLY, PLC (c.f., FIG. 13C). Meanwhile, the pattern layer PLM is superimposed on the pattern layers PLY, PLC. Thereafter, the transfer belt 361 moves to the image transfer position by the image forming unit FB.

The image forming unit FB transfers an image formed with the black liquid developer to the transfer belt 361. As a result, the transfer belt 361 carries the pattern layer PLB formed with the black liquid developer in addition to the pattern layers PLY, PLC, PLM (c.f., FIG. 13D). Meanwhile, the pattern layer PLB is superimposed on the pattern layers PLY, PLC, PLM. It should be noted that the black liquid developer preferably has the lowest fixing properties.

Thereafter, the pattern layers PLY, PLC, PLM, PLB are transferred to the sheet S (c.f., FIG. 14). The pattern layer PLB is adjacent to the surface of the sheet S. The pattern layer PLM is superimposed on the pattern layer PLB. The pattern layer PLC is superimposed on the pattern layer PLM. The pattern layer PLY is superimposed on the pattern layer PLC and appears on the outermost side.

<Fixing Device>

Figure 15:
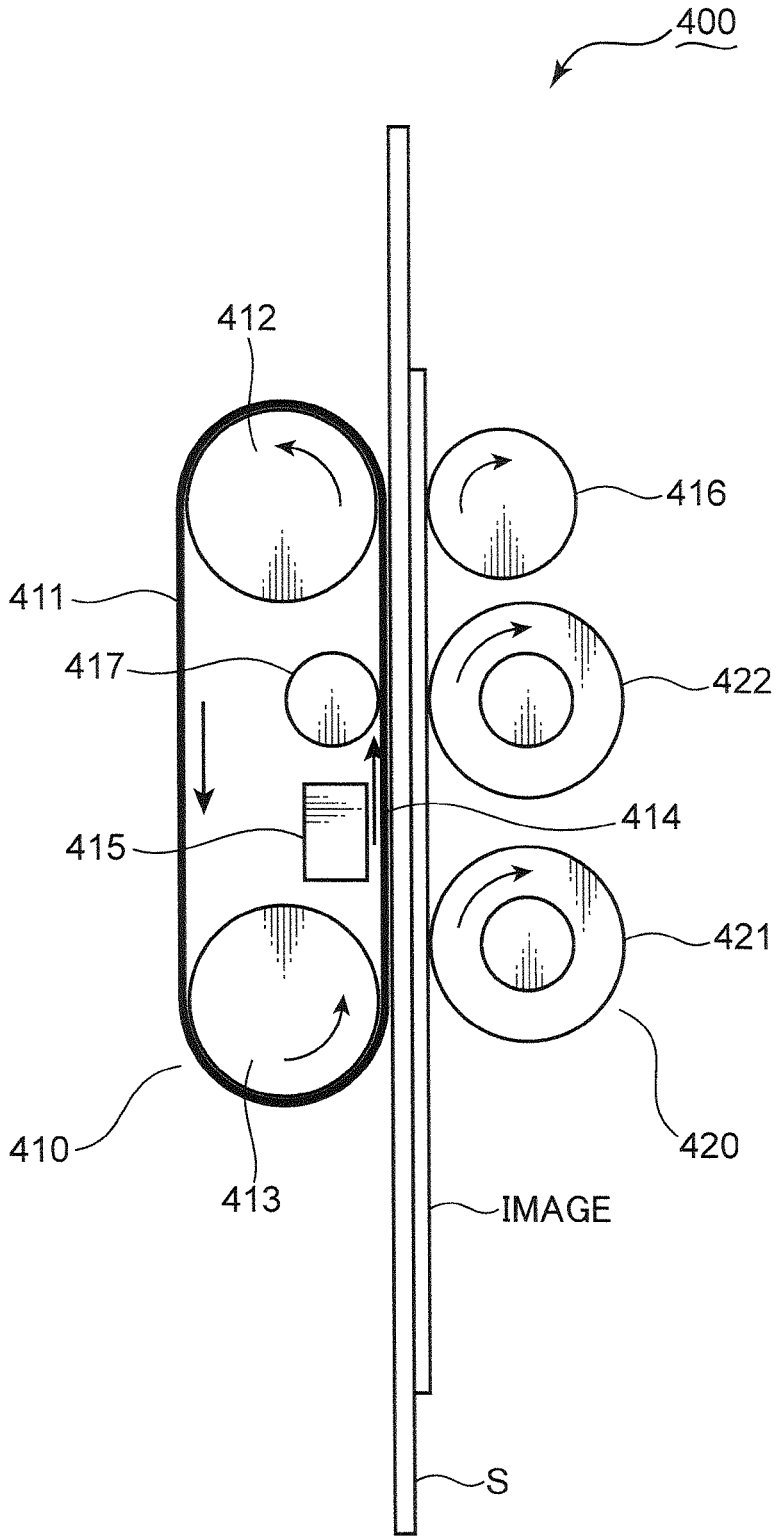
FIG. 15 is a schematic view of a fixing device of the image forming apparatus shown in FIG. 11.

FIG. 15 is a schematic view of the fixing device 400. The fixing device 400 is described with reference to FIGS. 4, 12 and 15.

The fixing device 400 includes a conveying mechanism 410, which conveys the sheet S upward, and a rubbing mechanism 420, which rubs an image layer I formed on the sheet S. The sheet S fed from the transfer mechanism 360 passes between the conveying mechanism 410 and the rubbing mechanism 420. It should be noted that the image layer I on the sheet S faces the rubbing mechanism 420.

The conveying mechanism 410 includes a conveyor belt 411, which stably conveys the sheet S, a drive roller 412, which drives the conveyor belt 411, and an idler 413, which defines a travel path of the conveyor belt 411 together with the drive roller 412. The drive roller 412 and the idler 413 form a flat surface (hereinafter, referred to as a flat surface 414) of the conveyor belt 411 facing the rubbing mechanism 420. The sheet S is supported on the flat surface 414 and conveyed upward.

In this embodiment, the conveyor belt 411 is formed with through holes (not shown). The conveying mechanism 410 further includes a vacuum device 415 configured to suck the sheet S on the flat surface 414 through the through holes of the conveyor belt 411. Since the vacuum device 415 sucks the sheet S on the flat surface 414, the sheet S is stably conveyed.

The conveying mechanism 410 further includes a nip roller 416 configured to sandwich the sheet S together with the conveyor belt 411 wound around the drive roller 412 at a downstream of the rubbing mechanism 420. The sheet S sandwiched between the nip roller 416 and the conveyor belt 411 is conveyed upward in accordance to the rotation of the nip roller 416 (and turning movement of the conveyor belt 411).

The rubbing mechanism 420 includes an upstream rubbing roller 421 situated near the idler 413 and a downstream rubbing roller 422 situated between the upstream rubbing roller 421 and the nip roller 416. The upstream and downstream rubbing rollers 421, 422 slightly press the sheet S toward the flat surface 414. The idler 413 reduces elastic deformation of the conveyor belt 411 caused by a pressing force by the upstream rubbing roller 421. Accordingly, the upstream rubbing roller 421 appropriately rubs the image on the sheet S. Thereafter, the downstream rubbing roller 422 rubs the image on the sheet S. In this embodiment, the upstream rubbing roller 421 is exemplified as the first rubbing portion. The downstream rubbing roller 422 is exemplified as the second rubbing portion.

The conveying mechanism 410 further includes a backup roller 417 situated near the downstream rubbing roller 422. The sheet S passes between the backup roller 417 and the downstream rubbing roller 422. The backup roller 417 reduces elastic deformation of the conveyor belt 411 caused by a pressing force by the downstream rubbing roller 422. Thus, the downstream rubbing roller 422 may appropriately rub the image on the sheet S.

The upstream and downstream rubbing rollers 421, 422 rotate in the same direction as the nip roller 416. Accordingly, the upstream and downstream rubbing rollers 421, 422 rubbing an image is less likely to interfere conveyance of the sheet S. It should be noted that rotation speeds of the upstream and downstream rubbing rollers 421, 422 are determined so that the circumferential surfaces of the upstream and downstream rubbing rollers 421, 422 move three to six times as fast as the conveying speed of the sheet S. Thus, the upstream and downstream rubbing rollers 421, 422 may appropriately rub the image layer I.

The circumferential surfaces of the upstream and downstream rubbing rollers 421, 422 are preferably covered with the materials shown in FIG. 4. If the circumferential surfaces of the upstream and downstream rubbing rollers 421, 422 are covered with different materials, the upstream and downstream rubbing rollers 421, 422 may achieve different fixation ratios. The types of the nonwoven fabrics covering the circumferential surfaces of the upstream and downstream rubbing rollers 421, 422 are appropriately determined according to types of liquid developer for forming images. Alternatively, a relative speed between the circumferential speed of the upstream rubbing roller 421 and the conveying speed of the sheet S may be different from that between the circumferential speed of the downstream rubbing roller 422 and the conveying speed of the sheet S. The speeds of the upstream and downstream rubbing rollers 421, 422 are appropriately determined in response to types of liquid developer for forming images.

Alternatively, the circumferential surfaces of the upstream and downstream rubbing rollers 421, 422 may be covered with nylon brushes for charging the sheet S. If the sheet S charged by the upstream and downstream rubbing rollers 422, 422 is electrostatically attracted to the conveyor belt 411, the sheet S may be stably conveyed even in absence of the vacuum device 415.

The principles of the aforementioned various embodiments result in appropriate rubbing processes for images formed with several types of liquid developer. As a result, the image is fixed to a sheet at a high fixation ratio.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus which uses at least two types of liquid developer to form a plurality of images that are superimposed on a sheet to form an image, comprising:

a transfer mechanism configured to transfer the image to the sheet;

an image forming mechanism configured to make the transfer mechanism carry the image; and a rubbing mechanism configured to rub the image on the sheet; wherein:

the at least two types of liquid developer have different fixing properties from each other;

the transfer mechanism includes a carrying surface configured to carry the image from the image forming mechanism; and one of the plurality of images between the carrying surface and another of the plurality of images has higher fixing properties than the liquid developer used for forming the other image among the plurality of images.

2. The image forming apparatus according to claim 1, wherein:

the at least two types of liquid developer include first liquid developer and second liquid developer which has lower fixing properties than the first liquid developer;

the image forming mechanism includes a first image forming mechanism configured to form a first image by means of the first liquid developer and a second image forming mechanism configured to form a second image by means of the second liquid developer; and the second image forming mechanism makes the transfer mechanism carry the second image to form the image after the first image forming mechanism makes the transfer mechanism carry the first image.

3. The image forming apparatus according to claim 2, further comprising a third image forming mechanism configured to form a third image by means of third liquid developer which has lower fixing properties than the second liquid developer, wherein:

the third image forming mechanism transfers the third image to the transfer mechanism after the second image forming mechanism and superimposes the third image on the first and second images.

4. The image forming apparatus according to claim 2, wherein:

a change rate of optical density of the first image when the first image is rubbed a predetermined number of times under a predetermined pressure is lower than that of optical density of the second image when the second image is rubbed the predetermined number of times under the predetermined pressure.

5. The image forming apparatus according to claim 3, wherein:

a change rate of optical density of the first image when the first image is rubbed a predetermined number of times under a predetermined pressure is lower than that of optical density of the second image when the second image is rubbed the predetermined number of times under the predetermined pressure; and a change rate of optical density of the third image when the third image is rubbed the predetermined number of times under the predetermined pressure is higher than the change rate of the second image.

6. The image forming apparatus according to claim 2, wherein:

the rubbing mechanism includes a first rubbing portion configured to rub the image on the sheet and a second rubbing portion configured to rub the image after the first rubbing portion.

7. The image forming apparatus according to claim 6, wherein:

the first rubbing portion fixes the image to the sheet at a fixation ratio different from the second rubbing portion.

8. An image forming method which uses at least two types of liquid developer to form a plurality of images that are super imposed on a sheet to form an image, comprising:

forming the image by transferring the plurality of images to a carrying surface;

transferring the image from the carrying surface to the sheet; and rubbing the image on the sheet, wherein one of the plurality of images between the carrying surface and another of the plurality of images has higher fixing properties than the liquid developer used for forming the other image among the plurality of images.

* * * * *